US011189219B2

(12) United States Patent
Park et al.

(10) Patent No.: US 11,189,219 B2
(45) Date of Patent: Nov. 30, 2021

(54) DISPLAY DEVICE AND DRIVING METHOD THEREOF

(71) Applicant: Samsung Display Co., Ltd., Yongin-si (KR)

(72) Inventors: Geun Jeong Park, Yongin-si (KR); Jeong Kyoo Kim, Yongin-si (KR); Chae Hee Park, Yongin-si (KR); Myung Woo Lee, Yongin-si (KR); Bit Na Lee, Yongin-si (KR); Man Seung Cho, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/064,564

(22) Filed: Oct. 6, 2020

(65) Prior Publication Data

US 2021/0174737 A1 Jun. 10, 2021

(30) Foreign Application Priority Data

Dec. 10, 2019 (KR) ..... 10-2019-0164052

(51) Int. Cl.
*G09G 3/32* (2016.01)

(52) U.S. Cl.
CPC ..... *G09G 3/32* (2013.01); *G09G 2310/027* (2013.01); *G09G 2310/0278* (2013.01)

(58) Field of Classification Search
CPC ..... G09G 3/32; G09G 2310/027; G09G 2310/0278
See application file for complete search history.

(56) References Cited

U.S. PATENT DOCUMENTS

| | | | | |
|---|---|---|---|---|
| 9,092,103 | B2 | 7/2015 | Choi et al. | |
| 10,545,593 | B2 * | 1/2020 | Kurasawa | G06F 3/04166 |
| 2014/0204049 | A1 * | 7/2014 | Tsai | G06F 3/0412 345/174 |
| 2018/0173923 | A1 * | 6/2018 | Lee | G06K 9/0002 |
| 2018/0329555 | A1 | 11/2018 | Kim et al. | |
| 2020/0142534 | A1 * | 5/2020 | Gu | G09G 3/3233 |
| 2020/0209925 | A1 * | 7/2020 | Paek | G09F 9/301 |
| 2020/0394984 | A1 * | 12/2020 | Park | G09G 5/373 |

FOREIGN PATENT DOCUMENTS

| | | |
|---|---|---|
| KR | 10-2014-0032043 | 3/2014 |
| KR | 10-2015-0000586 | 1/2015 |
| KR | 10-1979891 | 5/2019 |

* cited by examiner

*Primary Examiner* — Muhammad N Edun
(74) *Attorney, Agent, or Firm* — H.C. Park & Associates, PLC

(57) ABSTRACT

A display device includes a pixel unit including first pixels connected to a data line and second pixels connected to the data line; a sensing unit overlapping the first and second pixels, the sensing unit including sensing electrodes; and a sensing controller for receiving a sensing signal from at least some of the sensing electrodes in accordance with a sensing enable signal having a sensing-on level. In a first frame period, at least two of first data voltages having different levels are applied through the data line to the first pixels and second data voltages having the same level as each other but different from the first data voltages are applied through the data line to the second pixels. In the first frame period, the sensing enable signal has a sensing-off level while the first data voltages are applied and the sensing-on level while the second data voltages are applied.

20 Claims, 18 Drawing Sheets

<MODE2>

DISPLAY DEVICE AND DRIVING METHOD THEREOF

CROSS-REFERENCE TO RELATED APPLICATION

This application claims priority from and the benefit of Korean Patent Application No. 10-2019-0164052 filed on Dec. 10, 2019, which is hereby incorporated by reference for all purposes as if fully set forth herein.

BACKGROUND

Field

Exemplary implementations of the invention relate generally to a display device and, more specifically, to flexible display device and a driving method thereof capable of increasing touch sensing sensitivity when the display device is in a folded state.

Discussion of the Background

With the development of information technologies, the importance of a display device increases as a connection medium between user and information. Accordingly, display devices such as a liquid crystal display device, an organic light emitting display device, and a plasma display device are increasingly used.

A display device may include a pixel unit having a plurality of pixels and a sensing unit having a plurality of sensing electrodes. For example, while viewing an image displayed on the pixel unit, a user may touch the screen of the display device including the sensing unit to control the display device.

The above information disclosed in this Background section is only for understanding of the background of the inventive concepts, and, therefore, it may contain information that does not constitute prior art.

SUMMARY

Applicant discovered that coupling noise may be generated when a user touches a display screen due to voltage fluctuation in a data line connected to pixels, and touch sensing sensitivity may be also decreased due to the coupling noise.

Display devices constructed according to the principles and exemplary implementations of the invention and methods of driving the display devices according to the principles of the invention are capable of increasing touch sensing sensitivity when the display device is in a folded state by applying different driving methods to different pixel areas.

Additional features of the inventive concepts will be set forth in the description which follows, and in part will be apparent from the description, or may be learned by practice of the inventive concepts.

According to an aspect of the invention, a display device includes: a pixel unit including first pixels connected to a data line and second pixels connected to the data line; a sensing unit overlapping the first pixels and the second pixels, the sensing unit including sensing electrodes; and a sensing controller configured to receive a sensing signal from at least some of the sensing electrodes in accordance with a sensing enable signal having a sensing-on level. In a first frame period, at least two of first data voltages having different levels are applied through the data line, to the first pixels and second data voltages having the same level as each other but different from the first data voltages are applied through the data line to the second pixels. In the first frame period, the sensing enable signal has a sensing-off level while the first data voltages are applied and the sensing-on level while the second data voltages are applied.

The first frame period may include an active period in which the first data voltages and/or the second data voltages are applied to the data line and a blank period in which a reference voltage is applied to the data line. The sensing enable signal may have a sensing-on level during the blank period.

The second data voltages and the reference voltage may have the same level.

In a second frame period different from the first frame period, at least two of the first data voltages may have different levels. In the second frame period, at least two of the second data voltages may have different levels. In the second frame period, the sensing enable signal may have a sensing-on level while the first data voltages are being applied to the data line, and have a sensing-on level while the second data voltages are being applied to the data line.

The first pixels and the second pixels may be connected to different scan lines.

The scan lines to which the first pixels are connected may be consecutively arranged, and the scan lines to which the second pixels are connected may be consecutively arranged.

The first data voltages may be sequentially applied to the data line, and the second data voltages may be sequentially applied to the data line.

In the first frame period, the first pixels may be configured to display a color image. In the first frame period, the second pixels may be configured to display a black image or do not display any image.

In the first frame period, the pixel unit may be disposed in a folded portion of the display device.

In the first frame period, the pixel unit may be disposed in a folded portion of the display device with respect to a folding line located between the first pixels and the second pixels.

In the first frame period, the pixel unit may be disposed in a folded portion of the display device. In the second frame period, the pixel may be disposed in an unfolded portion of the display device.

In the first frame period, scan signals having a turn-off level may be maintained in the scan lines to which the second pixels are connected.

Images to be displayed by the first pixels and the second pixels in consecutive frame periods including the first frame period may have different frequencies from each other.

The consecutive frame periods may include include a second frame period prior to the first frame period. In the second frame period, at least two of the first data voltages may have different levels. In the second frame period, at least two of the second data voltages may have different levels. In the second frame period, the sensing enable signal may have the sensing-on level while the first data voltages are applied to the data line, and have the sensing-on level while the second data voltages are applied to the data line.

In the first frame period, scan signals having a turn-on level may be supplied at least once to the scan lines to which the first pixels are connected. In the first frame period, scan signals having a turn-off level may be maintained in at least some of the scan lines to which the second pixels are connected.

In the second frame period, scan signals having a first turn-on level may be supplied at least once to first scan lines among the scan lines to which the first pixels are connected. In the second frame period, scan signals having a second turn-on level may be supplied at least once to second scan lines among the scan lines to which the first pixels are connected. In the second frame period, scan signals having the first turn-on level may be supplied at least once to third scan lines among the scan lines to which the second pixels are connected. In the second frame period, scan signals having the second turn-on level may be supplied at least once to fourth scan lines among the scan lines to which the second pixels are connected. The first turn-on level and the second turn-on level may be different from each other.

In the first frame period, scan signals having the first turn-on level may be supplied at least once to the first scan lines. In the first frame period, scan signals having the second turn-on level may be supplied at least once to the second scan lines. In the first frame period, scan signals having a turn-off level may be maintained in the third scan lines. In the first frame period, scan signals having the second turn-on level may be supplied at least once to the fourth scan lines.

According to another aspect of the invention, a method for driving a display device having first pixels connected to a data line, second pixels connected to the data line, and sensing electrodes overlapping the first pixels and the second pixels, the method includes the steps of: in a first frame period, sequentially applying first data voltages having different levels through the data line to the first pixels, in the first frame period, sequentially applying second data voltages having the same level as each other but different from the first data voltages through the data line to the second pixels, and receiving a sensing signal from at least some of the sensing electrodes in accordance with a sensing enable signal. In the first frame period, the sensing enable signal has a sensing-off level while the first data voltages are applied, and has the sensing-on level while the second data voltages are applied.

In the first frame period, the first pixels may be configured to display a color image. In the first frame period, the second pixels may be configured to display a black image or do not display any image.

Images displayed by the first pixels and the second pixels may have different frequencies from each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
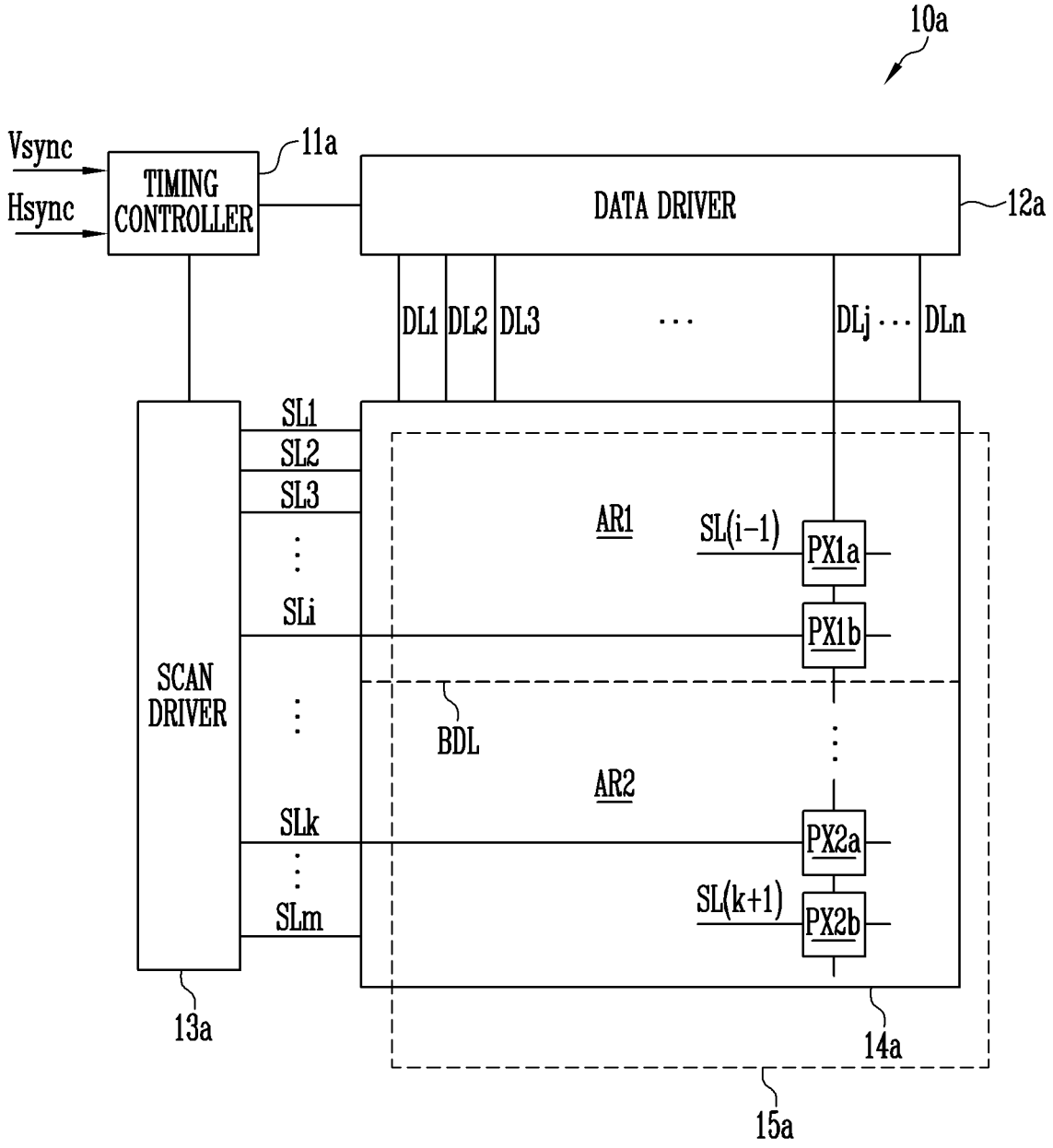
FIG. 1 is a block diagram of an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an exemplary embodiment of a display device constructed according to the principles of the invention.

Referring to FIG. 1, the display device 10*a* may include a timing controller 11*a*, a data driver 12*a*, a scan driver 13*a*, and a pixel unit 14*a*. The display device 10*a* may further include a sensing unit 15*a* overlapping with the pixel unit 14*a*. The sensing unit 15*a* will be described in more detail with reference to FIG. 4.

The timing controller 11*a* may receive grayscale values and control signals for each frame from an external processor. The control signals may include a vertical synchronization signal Vsync, a horizontal synchronization signal Hsync, a data enable signal, and the like. The vertical synchronization signal Vsync may include a plurality of pulses. When each pulse is generated, this may indicate that a previous frame period is ended and a current frame period is started with respect to the time at which the pulse is generated. The interval between adjacent pulses of the vertical synchronization signal Vsync may correspond to one frame period. The horizontal synchronization signal Hsync may include a plurality of pulses. When each pulse is generated, this may indicate that that a previous horizontal period is ended and a new horizontal period is started with respect to the time at which the pulse is generated. The interval between adjacent pulses of the horizontal synchronization signal Hsync may correspond to one horizontal period. In some exemplary embodiments, the one horizontal period may correspond to a minimum interval between start points of scan signals having a turn-on level. The data enable signal may have an enable level in specific horizontal periods, and have a disable level in the other periods. When the data enable signal has the enable level, this may indicate that grayscale values are supplied in the corresponding horizontal periods. The grayscale values may be supplied in a unit of a pixel row in each of the corresponding horizontal periods.

The timing controller 11*a* may render grayscale values to correspond to specifications of the display device 10*a*. For example, the external processor may provide a red grayscale value, a green grayscale value, and a blue grayscale value with respect to each unit dot. However, when the pixel unit 14*a* has a pentile structure, adjacent unit dots share a pixel, and therefore, pixels may not correspond one-to-one to the respective grayscale values. Accordingly, it may be necessary to render the grayscale values. When pixels may correspond one-to-one to the respective grayscale values, it may be unnecessary to render the grayscale values. Grayscale values which are rendered or are not rendered may be provided to the data driver 12*a*. Also, the timing controller 11*a* may provide the data driver 12*a*, the scan driver 13*a*, or the like with control signals suitable for specifications of the data driver 12*a*, the scan driver 13*a*, or the like for the purpose of frame display.

The data driver 12*a* may generate data voltages to be provided to data lines DL1, DL2, DL3, . . . , DLj, . . . , and DLn by using grayscale values and control signals. For example, the data driver 12*a* may sample the grayscale values by using a clock signal, and apply data voltages corresponding to the grayscale values to the data lines DL1 to DLn in a unit of a pixel row (e.g., pixels connected to the same scan line). Here, j and n may be integers greater than 0.

The scan driver 13*a* may generate scan signals to be provided to scan lines SL1, SL2, SL3, . . . , SL(i−1), SLi, . . . , SLk, SL(k+1), . . . , and SLm by receiving a clock signal, a scan start signal, and the like from the timing controller 11*a*. Here, i, k, and m may be integers greater than 0, k may be an integer greater than i, and m may be an integer greater than k.

The scan driver 13*a* may sequentially supply scan signals having a pulse of a turn-on level to the scan lines SL1 to SLm. The scan driver 13*a* may include scan stages configured in the form of shift registers. The scan driver 13*a* may generate scan signals in a manner that sequentially transfers the scan start signal in the form of a pulse of a turn-on level to a next scan stage under the control of the clock signal.

The pixel unit 14*a* may include pixels PX1*a*, PX1*b*, PX2*a*, and PX2*b*. Each of the pixels PX1*a*, PX1*b*, PX2*a*, and PX2*b* may be connected to a corresponding data line and a corresponding scan line. For example, first pixels PX1*a* and PX1*b* and second pixels PX2*a* and PX2*b* may be connected to a jth data line DLj. The first pixels PX1*a* and PX1*b* and the second pixels PX2*a* may be connected to different scan lines. In addition, scan lines SL(i−1) and SLi to which the first pixels PX1*a* and PX1*b* are connected may be consecutively arranged. Similarly, scan lines SLk and SL(k+1) to which the second pixels PX2*a* and PX2*b* are connected may be consecutively arranged.

The area in which the first pixels PX1*a* and PX1*b* are disposed may be defined as a first area AR1, and the area in which the second pixels PX2*a* and PX2*b* are disposed may be defined as a second area AR2. The first area AR1 and the second area AR2 may be predetermined areas of fixed dimensions. Alternatively, the first area AR1 and the second area AR2 may not be areas of fixed dimensions. The first area AR1 and the second area AR2 may be areas directly adjacent to each other with a boundary BDL interposed therebetween. Alternatively, the first area AR1 and the second area AR2 may be areas spaced apart from each other with the boundary BDL interposed therebetween.

For example, the boundary BDL may be a folding line. In another exemplary embodiment, the folding line may be replaced with a folding area. The display device 10*a* may be folded about the folding line or the folding area.

The folding line may be physically defined. For example, the display device 10*a* may further include a mechanical component such as a hinge, to be folded or unfolded with respect to only the folding line. In such a configuration, the folding line may be fixed. The first area AR1 and the second area AR2 may be fixed areas. In another exemplary embodiment, the display device 10*a* may include a flexible mount covering a display panel. The position of the folding line may vary. The first area AR1 and the second area AR2 may be varied according to the variation of the position of the folding line. The display device 10*a* may further include a pressure sensor, a flex sensor, a resistive sensor, etc. so as to detect the folding line. On the other hand, the display device 10*a* may detect the folding line by using the sensing unit 15*a* which will be described later.

In FIG. 1, for convenience of description, a case where the first pixels PX1*a* and PX1*b* and the second pixels PX2*a* and PX2*b* are connected to the same data line DLj is illustrated as an example. However, other first pixels of the first area AR1 and other second pixels of the second area AR2 may be connected to different data lines.

Figure 2:
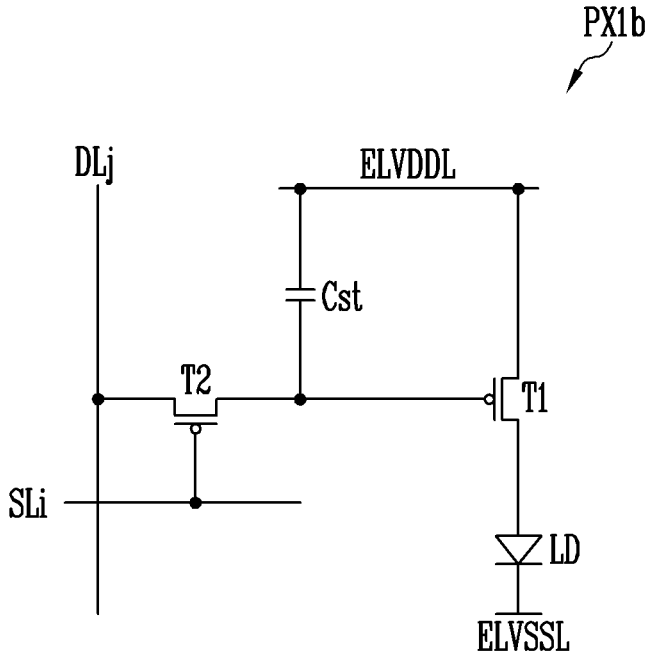
FIG. 2 is a circuit diagram of an exemplary embodiment of a representative pixel of the display device shown in FIG. 1.

FIG. 2 is a circuit diagram of an exemplary embodiment of a representative pixel of the display device shown in FIG. 1.

Referring to FIG. 2, an exemplary first pixel PX1*b* is illustrated. The other pixels PX1*a*, PX2*a*, and PX2*b* may have the substantially same configuration, and therefore, repetitive descriptions will be omitted.

A gate electrode of a first transistor T1 may be connected to a second electrode of a storage capacitor Cst, a first electrode of the first transistor T1 may be connected to a first power line ELVDDL, and a second electrode of the first transistor T1 may be connected to an anode electrode of the light emitting diode LD. The first transistor T1 may be referred to as a driving transistor.

A gate electrode of a second transistor T2 may be connected to a first scan line SL1, a first electrode of the second transistor T2 may be connected to a jth data line DLj, and a second electrode of the second transistor T2 may be connected to the second electrode of the storage capacitor Cst. The second transistor T2 may be referred to as a scan transistor.

A first electrode of the storage capacitor Cst may be connected to the first power line ELVDDL, and the second electrode of the storage capacitor Cst may be connected to the gate electrode of the first transistor T1.

The anode of the light emitting diode LD may be connected to the second electrode of the first transistor T1, and a cathode of the light emitting diode LD may be connected to a second power line ELVSSL.

During an emission period of the light emitting diode LD, a first power voltage applied to the first power line ELVDDL may be higher than a second power voltage applied to the second power line ELVSSL.

Although the first and second transistors T1 and T2 are implemented with a P-type transistor, those skilled in the art may replace at least one transistor with an N-type transistor by inverting the phase of a signal.

Figure 3:
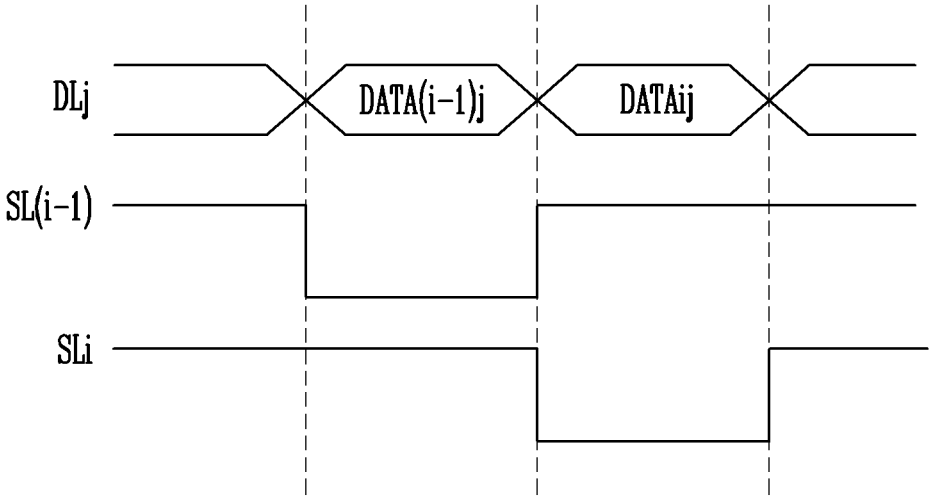
FIG. 3 is a timing diagram illustrating a driving method of the representative pixel of FIG. 2.

FIG. 3 is a timing diagram illustrating a driving method of the representative pixel of FIG. 2.

Data voltages DATA(i−1)j and DATAij corresponding to each pixel may be sequentially applied to the jth data line DLj.

First, a scan signal having a turn-on level (low level) may be applied to an (i−1)th scan line SL(i−1). The transistor T2 of the first pixel PX1*a* may be turned on, and the data voltage DATA(i−1)j applied to the data line DLj may be stored in the storage capacitor Cst of the first pixel PX1*a*.

Next, a scan signal having a turn-on level may be applied to an ith scan line SLi. The transistor T2 of the first pixel PX1*a* may be turned on, and the data voltage DATAij applied to the data line DLj may be stored in the storage capacitor Cst of the first pixel PX1*b*.

Therefore, the light emitting diode LD of the first pixel PX1*a* may emit light with a luminance corresponding to the data voltage DATA(i−1)j. The light emitting diode LD of the first pixel PX1*b* may emit light with a luminance corresponding to the data voltage DATAij.

Figure 4:
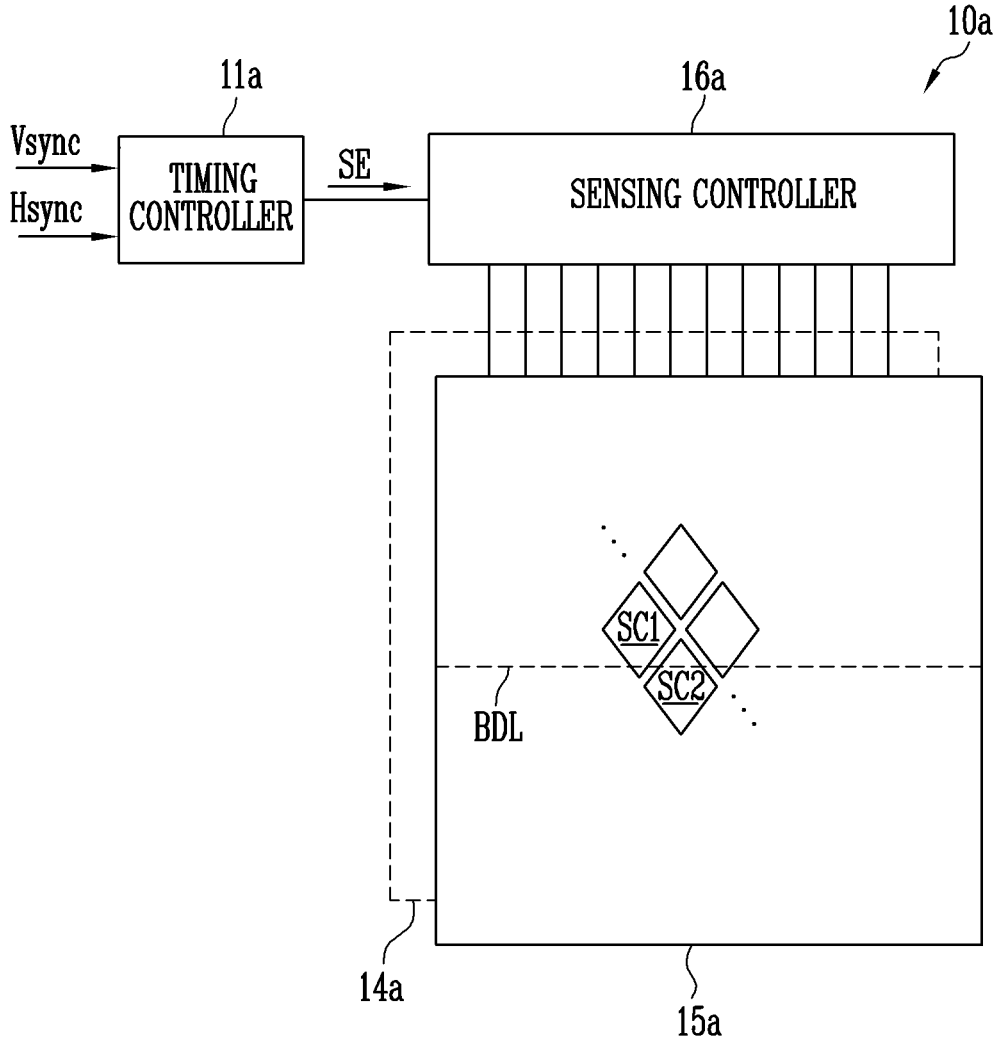
FIG. 4 is a block diagram of an exemplary embodiment of a sensing unit shown in FIG. 1.
Figure 5:
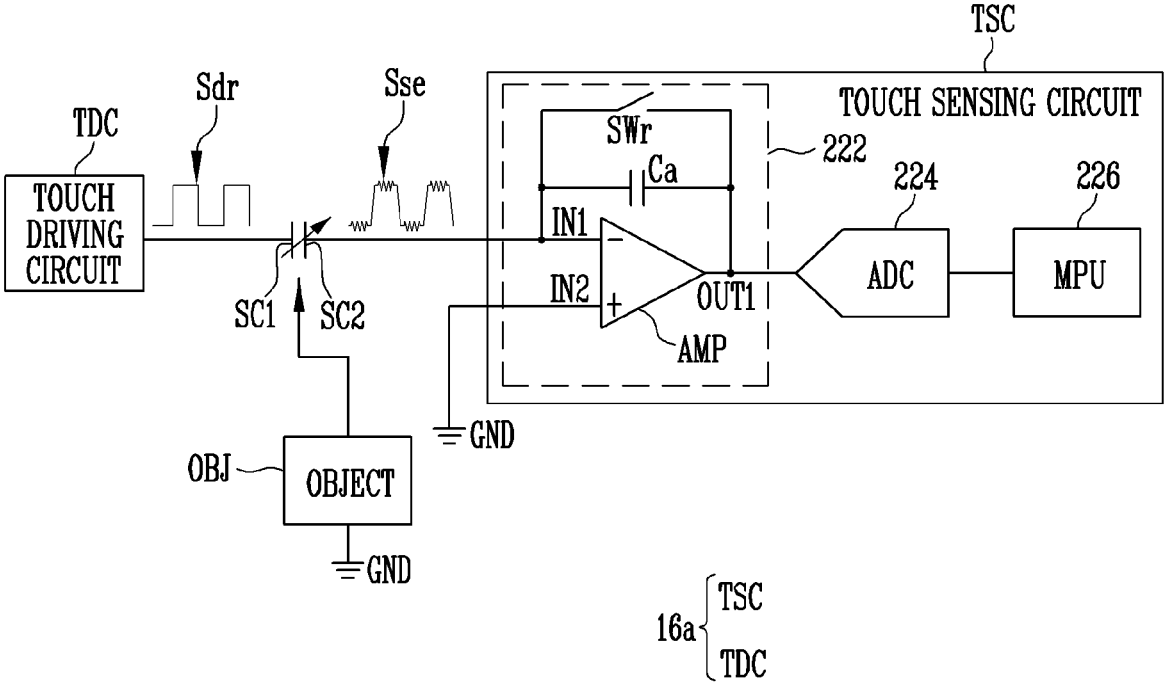
FIG. 5 is a diagram illustrating a sensing controller and a sensing unit of the display device shown in FIG. 4 in a mutual-capacitance mode.
Figure 6:
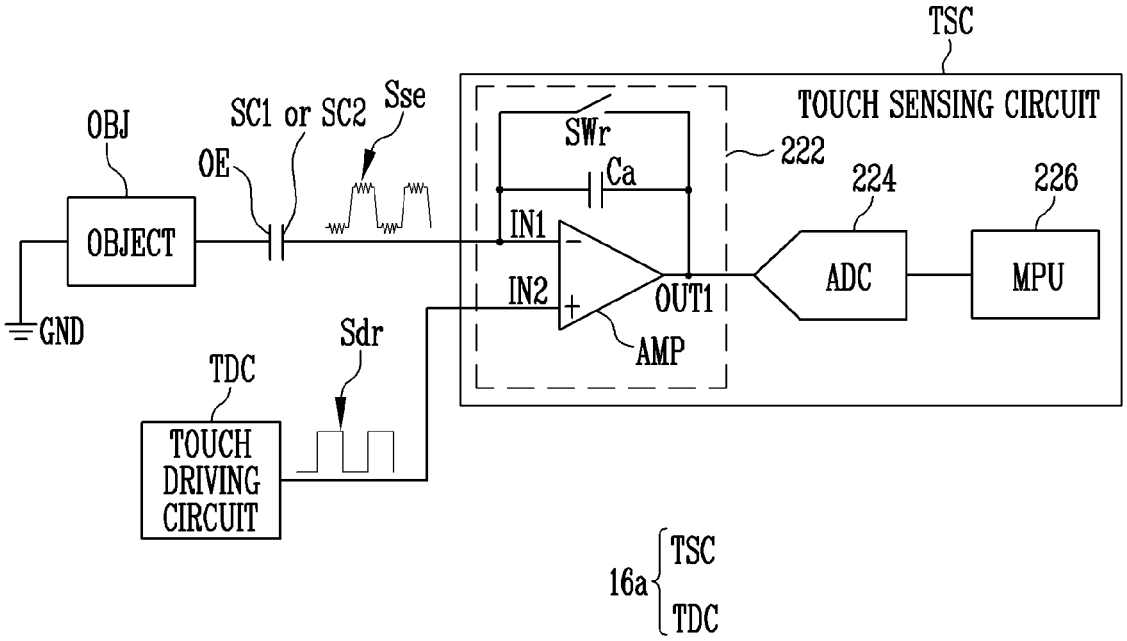
FIG. 6 is a diagram illustrating a sensing controller and a sensing unit of the display device shown in FIG. 4 in a self-capacitance mode.

FIGS. 4 to 6 are diagrams illustrating a sensing controller and a sensing unit of the display device.

FIG. 4 is a block diagram of an exemplary embodiment of a sensing unit shown in FIG. 1. Referring to FIG. 4, the display device 10*a* may further include the sensing unit 15*a* as shown in FIG. 1 and a sensing controller 16*a*.

The timing controller 11*a* may supply a sensing enable signal SE to the sensing controller 16*a*. When the sensing enable signal SE has a sensing-on level, the sensing controller 16*a* may receive a sensing signal from at least some of sensing electrodes SC1 and SC2. Therefore, the timing controller 11*a* or the sensing controller 16*a* may detect a touch position.

For example, when a sensing mode is a mutual-capacitance mode, the sensing controller 16*a* may receive a sensing signal from some sensing electrodes serving as Rx electrodes (receiving electrodes) among the sensing electrodes SC1 and SC2. For example, when the sensing mode is a self-capacitance mode, the sensing controller 16*a* may receive a sensing signal from all the sensing electrodes SC1 and SC2. In some exemplary embodiments, when the sensing mode is the self-capacitance mode, the sensing controller 16*a* may receive a sensing signal from some of the sensing electrodes SC1 and SC2.

When the sensing enable signal SE is a sensing-off level, the sensing controller 16*a* may not receive any sensing signal from the sensing electrodes SC1 and SC2. Therefore, the timing controller 11*a* or the sensing controller 16*a* may not detect any touch position.

The sensing unit 15*a* may include sensing electrodes SC1 and SC2. The sensing unit 15*a* may overlap with the pixel unit 14*a* including the pixels PX1*a* to PX2*b*. A first sensing electrode SC1 and a second sensing electrode SC2 may be connected to the sensing controller 16*a* through different lines. The first sensing electrode SC1 and the second sensing electrode SC2 may be formed in the same layer or be formed in different layers. When the sensing mode is the mutual-capacitance mode, the first sensing electrode SC1 may be a Tx electrode (transmitting electrode), and the second sensing electrode SC2 may be an Rx electrode (receiving electrode). When the sensing mode is the self-capacitance mode, the sensing electrodes SC1 and SC2 are not distinguished as the Tx electrode and the Rx electrode. The shapes and positions of the sensing electrodes SC1 and SC2 are determined by considering capacitance, visibility, and the like, and are not fixed. For example, although a case where the sensing electrodes SC1 and SC2 are provided in a rhombus shape is illustrated in FIG. 4, the sensing electrodes SC1 and SC2 may be provided in various shapes such as a circular shape, a quadrangular shape, a rod shape, and a mesh shape.

FIG. 5 is a diagram illustrating a sensing controller and a sensing unit of the display device shown in FIG. 4 in a mutual-capacitance mode. Referring to FIG. 5, in the mutual-capacitance mode, an exemplary relationship of the sensing controller 16*a* and the sensing electrodes SC1 and SC2 is illustrated. The sensing controller 16*a* may include a touch driving circuit TDC and a touch sensing circuit TSC.

The first sensing electrode SC1 may be connected to the touch driving circuit TDC, and the second sensing electrode SC2 may be connected to the touch sensing circuit TSC.

The touch sensing circuit TSC may include an operational amplifier AMP, and the second sensing electrode SC2 may be connected to a first input terminal IN1 of the operational amplifier AMP. A second input terminal IN2 of the operational amplifier AMP may be connected to a reference voltage source GND.

A driving signal Sdr is supplied to the first sensing electrode SC1 from the touch driving circuit TDC during a touch sensing period in which a touch sensing mode is activated. In some exemplary embodiments, the driving signal Sdr may be an AC signal having a predetermined period, such as a pulse wave.

The touch sensing circuit TSC may sense the second sensing electrode SC2 by using a sensing signal Sse generated by the driving signal Sdr. The sensing signal Sse may be generated based on a mutual capacitance formed by the first sensing electrode SC1 and the second sensing electrode SC2. The mutual capacitance formed by the first sensing electrode SC1 and the second sensing electrode SC2 may be changed depending on a degree to which an object OBJ such as a finger of a user approaches the first sensing electrode SC1, and accordingly, the sensing signal Sse may vary. Whether the object OBJ has touched may be detected using a difference between sensing signals Sse.

In some exemplary embodiments, each second sensing electrode SC2 along with an operational amplifier AMP connected to the second sensing electrode SC2 (or an analog front end (AFE) having the operational amplifier AMP) may constitute a sensing channel 222. However, for convenience of description, the second sensing electrodes SC2 and sensing channels 222 constituting a signal receiver of the touch sensing circuit TSC, which are distinguished from each other, will be described hereinbelow.

The touch sensing circuit TSC amplifies, converts, and processes sensing signals Sse input from the respective second sensing electrodes SC2, and detects a touch input, based on a result thereof. To this end, the touch sensing circuit TSC may include a sensing channel 222 corresponding to each of the second sensing electrode SC2, and an analog-to-digital converter (ADC) 224 and a processor 226, which are connected to the sensing channel 222.

In some exemplary embodiments, each sensing channel 222 may be configured as an AFE which receives a sensing signal Sse from a second sensing electrode SC2 corresponding thereto. In an example, each sensing channel 222 may be implemented as an AFE including at least one operational amplifier AMP.

The sensing channel 222 may include a first input terminal IN1 (e.g., an inverting input terminal of the operational amplifier AMP) and a second input terminal IN2 (e.g., a non-inverting input terminal of the operation amplifier AMP), and generate an output signal corresponding to a difference in voltage between the first and second input terminal IN1 and IN2. For example, the sensing channel 222 may amplify (i.e., differentially amplify) a difference in voltage between the first and second input terminals IN1 and IN2 to a degree corresponding to a predetermined gain, and output the amplified voltage.

The second input terminal IN2 of each sensing channel 222 may be a reference potential terminal. In an example, the second input terminal IN2 may be connected to the reference voltage source GND such as a ground power source. Accordingly, the sensing channel 222 amplifies and outputs a sensing signal Sse input to the first input terminal IN1 with respect to a potential of the second input terminal IN2. That is, each sensing channel 222 receives a sensing signal Sse from a corresponding second sensing electrode SC2 through the first input terminal IN1, and amplifies and outputs a signal (difference voltage) corresponding to the difference between a voltage of the first input terminal IN1 and a voltage of the second input terminal IN2, thereby amplifying the sensing signal Sse.

In some exemplary embodiments, the operational amplifier AMP may be implemented as an integrator. A capacitor Ca and a reset switch SWr may be connected in parallel to each other between the first input terminal IN1 and an output terminal OUT1 of the operational amplifier AMP. For example, the reset switch SWr is turned on before a sensing signal Sse is sensed, so that charges of the capacitor Ca can be initialized. The reset switch SWr may be in a turn-off state at a time at which the sensing signal Sse is sensed.

The ADC 224 converts an analog signal input from each sensing channel 222 into a digital signal. In some exemplary embodiments, the ADC 224 may be provided in the same as that of second sensing electrodes to correspond one-to-one to the sensing channels 222 corresponding to the second sensing electrodes. In another exemplary embodiment, at least two sensing channels 222 may share one ADC 224. A switch for channel selection may be additionally provided between the sensing channels 222 and the ADC 224.

The processor 226 detects a touch input by using a sensing signal Sse output from each second sensing electrode SC2. For example, the processor 226 may detect whether a touch input has occurred and a position of the touch input by processing a signal (i.e., an amplified and digital-converted sensing signal Sse) input via a corresponding sensing channel 222 and a corresponding ADC 224 from each of a plurality of second sensing electrodes in a predetermined form which can be analyzed, and synthetically analyzing sensing signals Sse output from the second sensing electrodes.

In some exemplary embodiments, the processor 226 may be implemented as a microprocessor (MPU). A memory necessary for driving of the processor 226 may be additionally provided in the touch sensing circuit TSC. The configuration of the processor 226 is not limited thereto. In another example, the processor 226 may be implemented as a microcontroller (MCU) or the like.

FIG. 6 is a diagram illustrating a sensing controller and a sensing unit of the display device shown in FIG. 4 in a self-capacitance mode. Referring to FIG. 6, in the self-capacitance mode, an exemplary relationship of the sensing controller 16*a* and the sensing electrodes SC1 and SC2 is illustrated.

In FIG. 6, a case where the sensing controller 16*a* and the sensing electrodes SC1 and SC2 operate in the self-capacitance mode. The first sensing electrode SC1 or the second sensing electrode SC2 may be connected to the touch sensing circuit TSC. That is, at least some of the first sensing electrodes and the second sensing electrodes may be connected to a corresponding sensing channel 222.

Unlike the mutual-capacitance mode, in the self-capacitance mode, the first sensing electrode SC1 or the second sensing electrode SC2 may be connected to the first input terminal IN1 of a corresponding operational amplifier AMP. The second input terminal IN2 of the operational amplifier AMP may be connected to the touch driving circuit TDC.

The touch sensing circuit TSC may sense the second sensing electrode SC2 by using a sensing signal Sse generated by a driving signal Sdr. When an object OBJ such as a finger of a user approaches the first sensing electrode SC1 or the second sensing electrode SC2, a sensing signal Sse is generated base on a self-capacitance formed by an object surface OE and the first sensing electrode SC1 or the second sensing electrode SC2. On the other hand, when an object OBJ such as a finger of a user does not approach the first sensing electrode SC1 or the second sensing electrode SC2, a sensing signal Sse is generated regardless of the self-capacitance. Whether the object OBJ has touched may be detected using a difference between the sensing signals Sse.

Repetitive descriptions of the touch sensing circuit TSC and the touch driving circuit TDC will be omitted to avoid redundancy.

FIGS. 7 to 11 are diagrams illustrating a driving method of the display device shown in FIG. 1 in a first mode and a driving method of the display device shown in FIG. 1 in a second mode.

Figure 7:
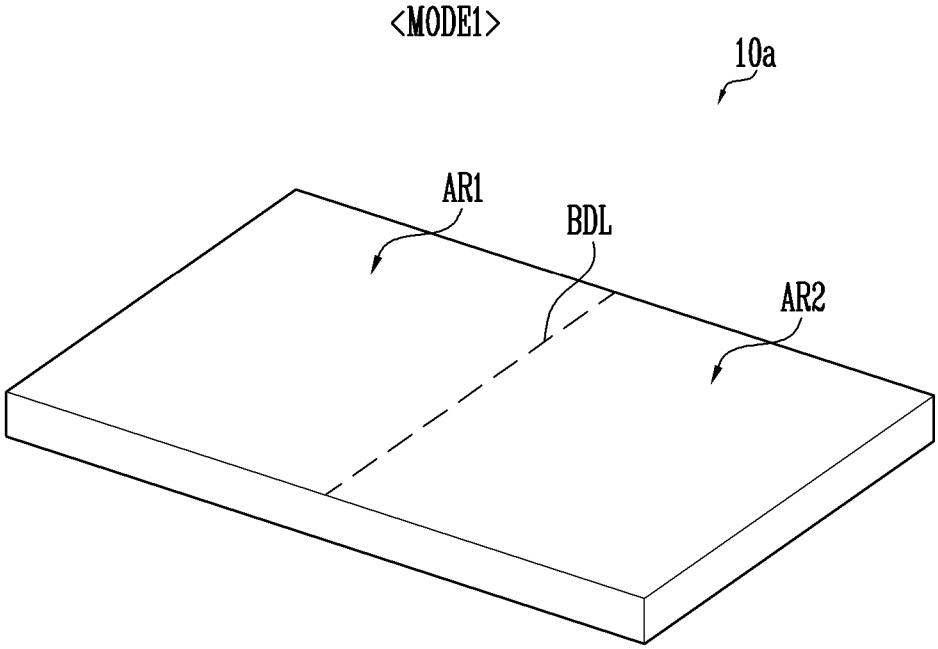
FIG. 7 is perspective view of the display device of FIG. 1 in a first mode (unfolded state).

FIG. 7 is perspective view of the display device of FIG. 1 in a first mode (unfolded state). Referring to FIG. 7, the display device 10*a* may operate in a first mode MODE1 when the display device 10*a* is in an unfolded state. For example, in the first mode MODE1, the display device 10*a* may display an image in both the areas AR1 and AR2, without distinguishing the boundary BDL and the areas AR1 and AR2. The image that is displayed may be a case where grayscale values for the pixels of the areas AR1 and AR2 are provided.

Figure 8:
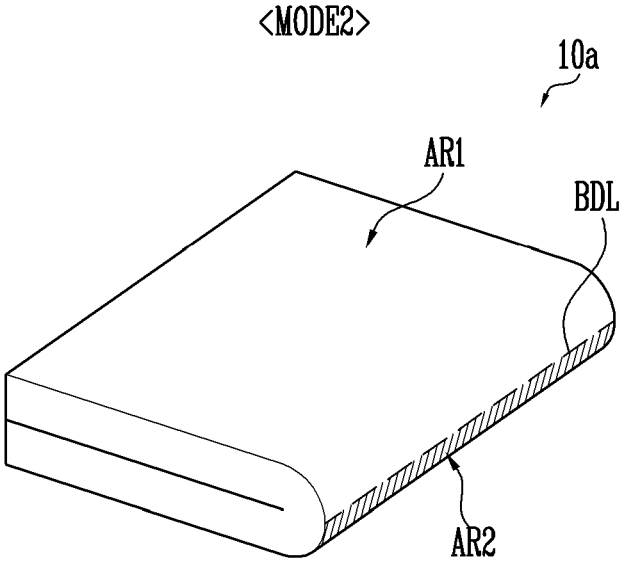
FIG. 8 is perspective view of the display device of FIG. 1 in a second mode (folded state).

FIG. 8 is perspective view of the display device of FIG. 1 in a second mode (folded state). Referring to FIG. 8, the display device 10*a* may operate in a second mode MODE2 when the display device 10*a* is in a folded state. For example, in the second mode MODE2, the display device 10*a* displays an image in the first area AR1, and may not display the image in the second area AR2 or may display a black image in the second area AR2. The image that is not displayed may be a case where grayscale values for the second pixels of the second area AR2 are not provided or a case where dummy grayscale values are provided. The black image that is displayed may be a case where grayscale values corresponding to a black grayscale are provided to the second pixels of the second area AR2.

Figure 9:
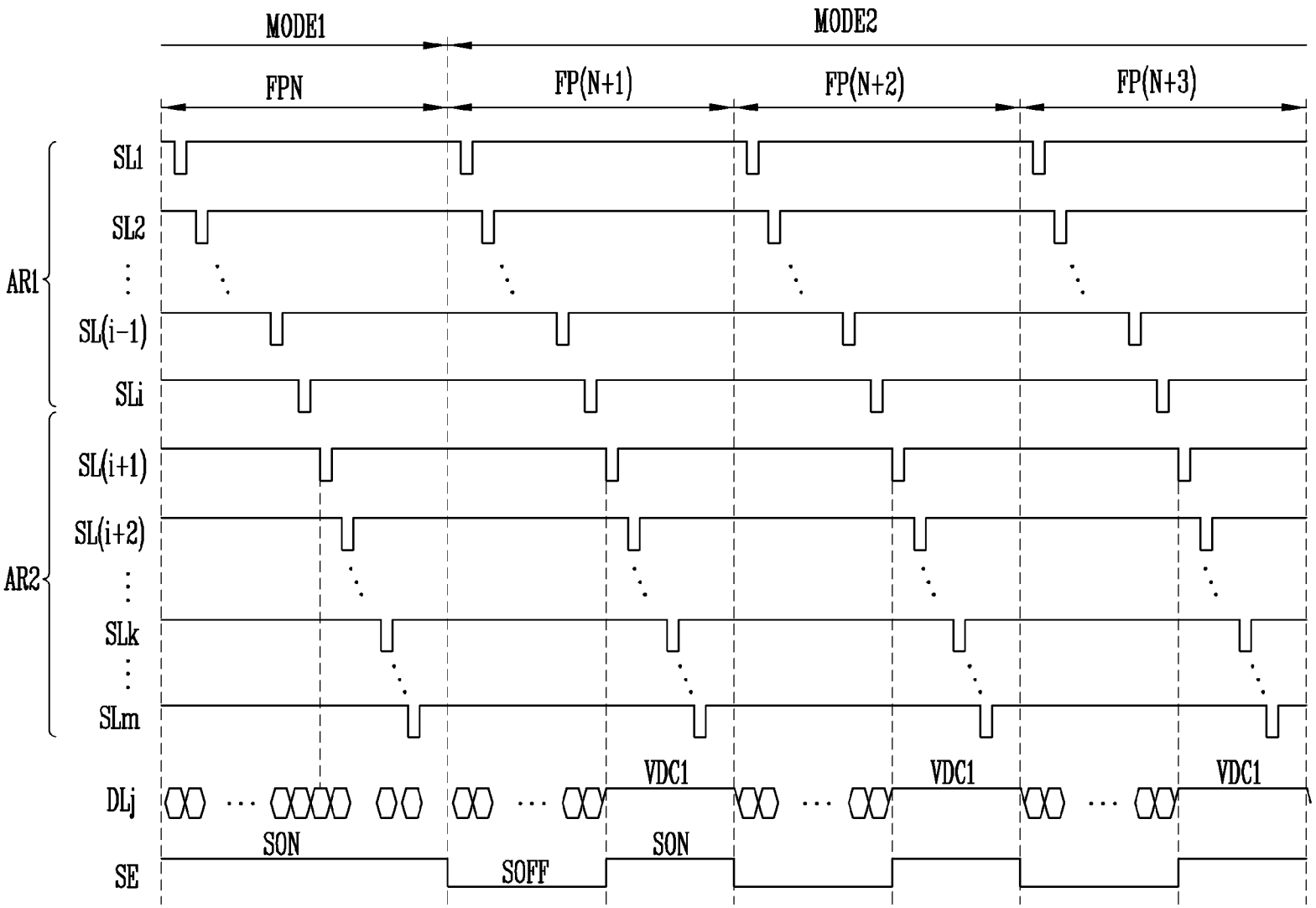
FIG. 9 is a timing diagram of an exemplary embodiment of a driving method of the display device shown in FIG. 1 in first and second modes.

FIG. 9 is a timing diagram of an exemplary embodiment of a driving method of the display device shown in FIG. 1 in first and second modes. Referring to FIG. 9, an Nth frame period FPN may belong to a period in which the display device 10*a* is driven in the first mode MODE1, and (N+1)th, (N+2)th, and (N+3)th frame periods FP(N+1), FP(N+2), and FP(N+3) may belong to a period in which the display device 10*a* is driven in the second mode MODE2. For example, this may be a case where the mode of the display device 10*a* is changed from the unfolded state to the folded state just before the time of the (N+1)th frame period FP(N+1).

The scan lines SL1 to SLi may be connected to the first pixels of the first area AR1. The scan lines SL(i+1) to SLm may be connected to the second pixels of the second area AR2.

In the Nth frame period FPN, at least two of first data voltages applied to the data line DLj, corresponding to the first pixels, may have different levels. That is, the first area AR1 may display an image instead of a single color. Also, in the Nth frame period FPN, at least two of second data voltages applied to the data line DLj, corresponding to the second pixels, may have different levels. That is, the second area AR2 may display an image (e.g., color image) instead of a single color (e.g., black-white color image).

In the Nth frame period FPN, the sensing enable signal SE may have a sensing-on level SON while the first data voltages are being applied to the data line DLj, and have the sensing-on level SON while the second data voltages are being applied to the data line DLj. That is, the sensing enable signal SE may have the sensing-on level SON throughout the entire Nth frame period FPN. In FIG. 9 and the following drawings, for convenience of description, the sensing-on level SON is represented as a logic high level, and a sensing-off level SOFF is represented as a logic low level. In another exemplary embodiment, the sensing-on level SON may be the logic low level, and the sensing-off level SOFF may be the logic high level. For example, when the sensing enable signal SE as the sensing-on level SON is applied, the sensing controller 16*a* can be operated. On the contrary, when the sensing enable signal SE as the sensing-off level SOFF is applied, the sensing controller 16*a* cannot be operated.

In the first mode MODE1, the sensing-on level SON may be maintained throughout the entire Nth frame period FPN, due to coupling noise caused due to voltage fluctuation of the data line DLj. For example, the timing controller 11*a* or the sensing controller 16*a* compensates for a decrease in sensing sensitivity due to the coupling noise through a plurality of sensing values, so that a touch position can be more accurately determined.

In the (N+1)th frame period FP(N+1), at least two of first data voltages applied to the data line DLj, corresponding to the first pixels, may have different levels. That is, the first area AR1 may display an image instead of a single color. Also, in the (N+1)th frame period FP(N+1), second data voltages applied to the data line DLj, corresponding to the second pixels, may have the same level VDC1. For example, the level of the second data voltages may correspond to a black grayscale.

In the (N+1)th frame period FP(N+1), the sensing enable signal SE may have the sensing-off level SOFF while the first data voltages are being applied to the data line DLj, and have the sensing-on level SON while the second data voltages are being applied to the data line DLj. That is, the sensing enable signal SE may have the sensing-on level SON in only a partial period of the (N+1)th frame period FP(N+1).

Since the level VDC1 of the second data voltages is maintained (i.e., a DC level), the coupling noise is not generated while the second data voltages are being applied to the data line DLj. Thus, the timing controller 11*a* or the sensing controller 16*a* senses a touch position only while the second data voltages are being applied to the data line DLj, so that high sensing sensitivity can be maintained. Touch sensing may be made at a front surface of the sensing unit 15*a*, and is not limited to a portion overlapping the second area AR2.

Further, although the sensing period in the (N+1)th frame period FP(N+1) is shorter than that of the Nth frame period FPN of the first mode, the short sensing period can be compensated due to the high sensing sensitivity. Furthermore, the sensing controller 16*a* and the sensing unit 15*a* do not operate while the first data voltages are being applied to the data line DLj, and accordingly, power consumption can be reduced.

Operation of the other (N+2)th and (N+3)th frame periods FP(N+2) and FP(N+3) of the second mode is the substantially same as that of the (N+1)th frame period FP(N+1), and therefore, repetitive descriptions will be omitted.

Figure 10:
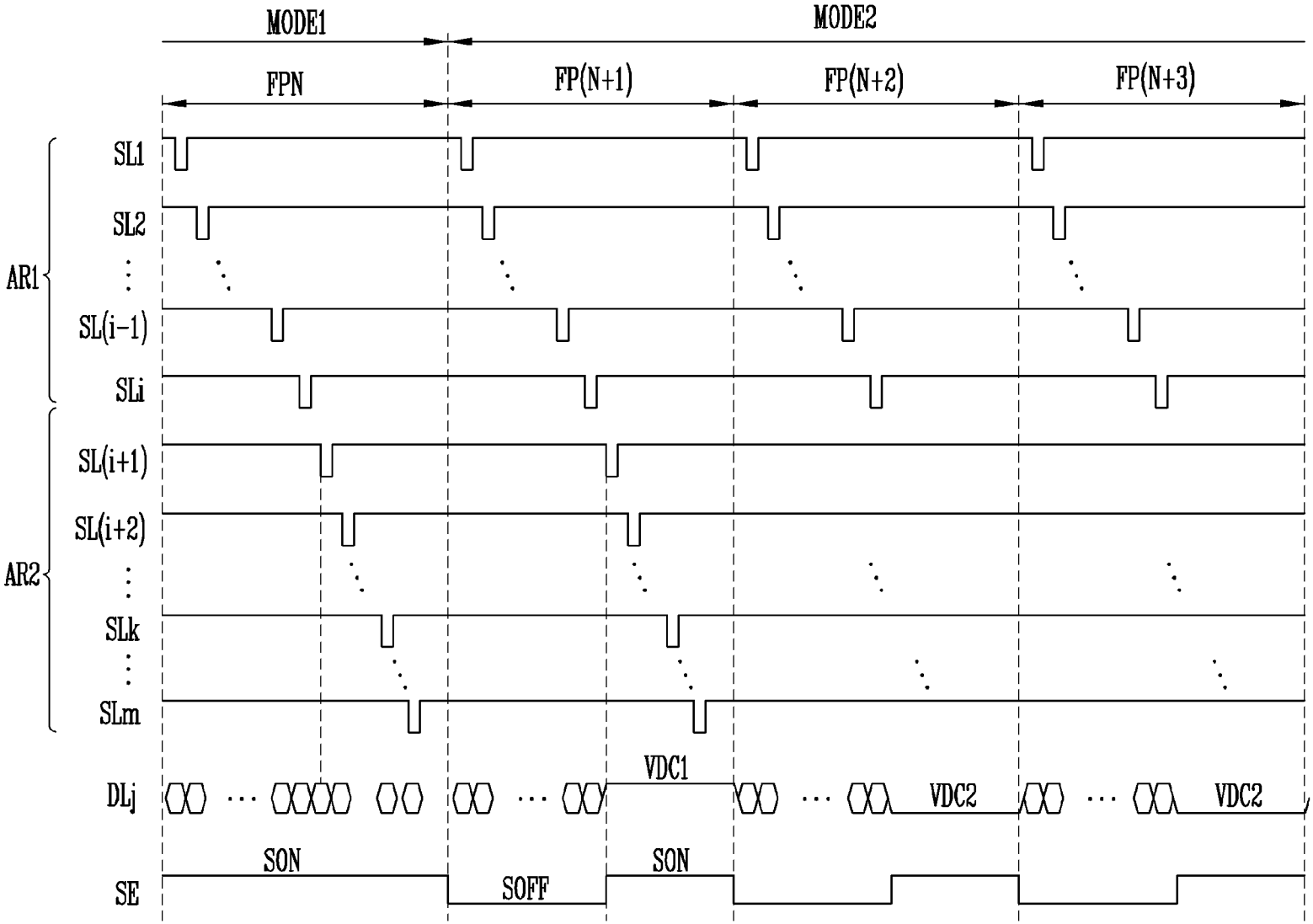
FIG. 10 is a timing diagram of another exemplary embodiment of a driving method of the display device shown in FIG. 1 in first and second modes.

FIG. 10 is a timing diagram of another exemplary embodiment of a driving method of the display device shown in FIG. 1 in first and second modes. Referring to FIG. 10, a case where the display device 10*a* is driven using a method different from that shown in FIG. 9 in the second mode MODE2 is described. A driving method of the frame period FPN in the first mode MODE1 is the substantially same as that shown in FIG. 9, and therefore repetitive descriptions will be omitted.

In the (N+1)th frame period FP(N+1) as a first frame period of the second mode MODE2, at least two of first data voltages applied to the data line DLj, corresponding to the first pixels, may have different levels. That is, the first area AR1 may display an image instead of a single color. Also, in the (N+1)th frame period FP(N+1), second data voltages applied to the data line DLj, corresponding to the second pixels, may have the same level VDC1. The level VDC1 of the second data voltages may correspond to a black grayscale. Therefore, the second area AR2 may display a black image.

In the (N+1)th frame period FP(N+1), the sensing enable signal SE may have the sensing-off level SOFF while the first data voltages are being applied to the data line DLj, and have the sensing-on level SON while the second data voltages are being applied to the data line DLj. That is, the sensing enable signal SE may have the sensing-on level SON in only a partial period of the (N+1)th frame period FP(N+1).

Since the level VDC1 of the second data voltages is maintained (i.e., a DC level), the coupling noise is not generated while the second data voltages are being applied to the data line DLj. Thus, the timing controller 11*a* or the sensing controller 16*a* senses a touch position only while the second data voltages are being applied to the data line DLj, so that high sensing sensitivity can be exhibited.

In the (N+2)th frame period FP(N+2) as a second frame period of the second mode MODE2, at least two of first data voltages applied to the data line DLj, corresponding to the first pixels, may different levels. In the (N+2)th frame period FP(N+2), scan signals having a turn-on level may be sequentially applied to the scan lines SL1, SL2, . . . , SL(i−1), and SLi. Accordingly, the first data voltages may be stored in the first pixels, and the first area AR1 may display an image instead of a single color.

Also, in the (N+2)th frame period FP(N+2), second data voltages applied to the data line DLj, corresponding to the second pixels, may have the same level VDC2. The level VDC2 of the second data voltages may not correspond to the black grayscale. In the (N+2)th frame period FP(N+2), scan signals having a turn-off level, which are applied to the scan lines SL(i+1), SL(i+2), . . . , SLk, . . . , and SLm to which the second pixels are connected, may be maintained. Thus, since the second data voltages are not stored in the second pixels, the second area AR2 can continuously display the black image, regardless of the level VDC2 of the second data voltages.

The data driver 12*a* does not supply the second data voltages by using the existing buffer unit (e.g., a plurality of amplifiers), but may supply the second data voltages by using separate amplifiers. Since it is unnecessary to charge the second pixels, a large amount of current is not required. Thus, the second data voltages can be supplied using a small number of amplifiers (e.g., a single amplifier). Accordingly, power consumption can be reduced.

For example, the level VDC2 of the second data voltages in the (N+2)th frame period FP(N+2) may be smaller than that VDC1 of the second data voltages in the (N+1)th frame period FP(N+1). For example, the second data voltages in the (N+2)th frame period FP(N+2) may correspond to a ground voltage.

In the (N+2)th frame period FP(N+2), the sensing enable signal SE may have the sensing-off level SOFF while the first data voltages are being applied to the data line DLj, and have the sensing-on level SON while the second data voltages are being applied to the data line DLj. That is, the sensing enable signal SE may have the sensing-on level SON in only a partial period of the (N+2)th frame period FP(N+2).

Since the level VDC2 of the second data voltages is maintained (i.e., a DC level), the coupling noise is not generated while the second data voltages are being applied to the data line DLj. Thus, the timing controller 11*a* or the sensing controller 16*a* senses a touch position only while the second data voltages are being applied to the data line DLj, so that high sensing sensitivity can be maintained.

As described above, although a sensing period in the (N+1)th frame period FP(N+1) is shorter than that of the Nth frame period FPN of the first mode, the short sensing period can be compensated due to the high sensing sensitivity. Further, the sensing controller 16*a* and the sensing unit 15*a* do not operate while the first data voltages are being applied to the data line DLj, and accordingly, power consumption can be reduced.

The operation of the other (N+3)th frame period FP(N+3) of the second mode MODE2 is substantially identical to that of the (N+2)th frame period FP(N+2), and therefore, repetitive descriptions will be omitted.

Figure 11:
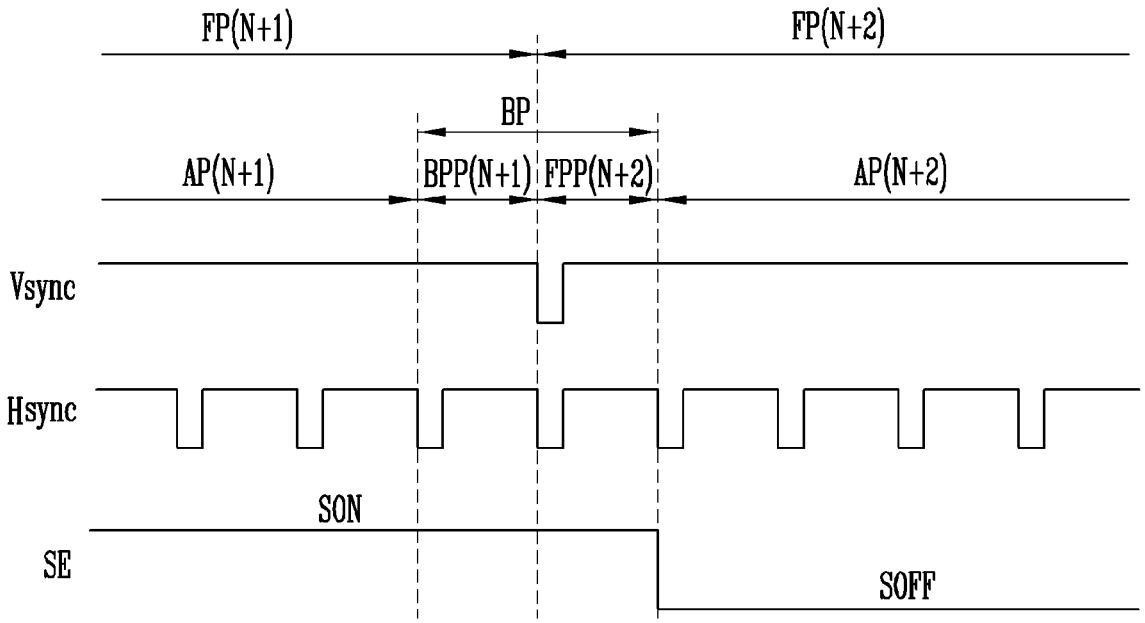
FIG. 11 is an enlarged timing diagram of a transition period in which the frame period is changed to the next frame period.

FIG. 11 is an enlarged timing diagram of a transition period in which the frame period is changed to the next frame period. Referring to FIG. 11, an enlarged timing diagram of a transition period in which the (N+1)th frame period FP(N+1) is changed to the (N+2)th frame period FP(N+2) is illustrated.

Each frame period may include an active period AP and a blank period BP. The blank period BP may include a front porch period FPP prior to the active period AP and a back porch period BPP posterior to the active period AP. For example, referring to FIG. 11, the blank period BP may include a front porch period FPP(N+2) prior to the active period AP(N+2) of the (N+2)th frame period FP(N+2) and a back porch period BPP(N+1) posterior to the active period AP(N+1) of the (N+1)th frame period FP(N+1). The front porch period FPP(N+2) may mean a period between a time at which the frame period FP(N+2) is started and a time at which the active period AP(N+2) is started. The active period AP may mean a period in which grayscale values corresponding to a frame are provided. The back porch period BPP(N+1) may mean a period between a time at which the active period AP(N+1) is ended and a time at which the frame period FP(N+1) is ended.

The front porch FPP period may be started from a time at which a pulse of the vertical synchronization signal Vsync is generated. The front porch period may have a length corresponding to integer times of the period of the horizontal synchronization signal Hsync. Although a case where the length of the front porch period FPP(N+2) corresponds to one period of the horizontal synchronization signal Hsync is illustrated in FIG. 11, the exemplary embodiments are not limited thereto.

Referring to FIG. 11, the (N+1)th frame period FP(N+1) may include an (N+1)th active period AP(N+1) and a (N+1)th back porch period BPP(N+1). The (N+2)th frame period FP(N+2) may include a (N+2)th front porch period FPP(N+2) and an (N+2)th active period AP(N+2).

As described above, grayscale values for the pixels are provided in the active periods AP(N+1) and AP(N+2), and are not provided in the blank period BP. Therefore, the first data voltages and/or the second data voltages may be applied to the data line DLj in the active periods AP(N+1) and AP(N+2). In addition, a predetermined reference voltage may be applied to the data line DLj in the blank period BP and the second data voltages and the reference voltage may have the same level. Thus, in the blank period BP, the voltage of the data line DLj can be constantly maintained, and the coupling noise does not occur.

In accordance with this exemplary embodiment, the sensing enable signal SE may have the sensing-on level SON in the blank period BP. Accordingly, the time for which the sensing-on level SON is maintained is lengthened, so that sensing sensitivity can be increased.

Figure 12:
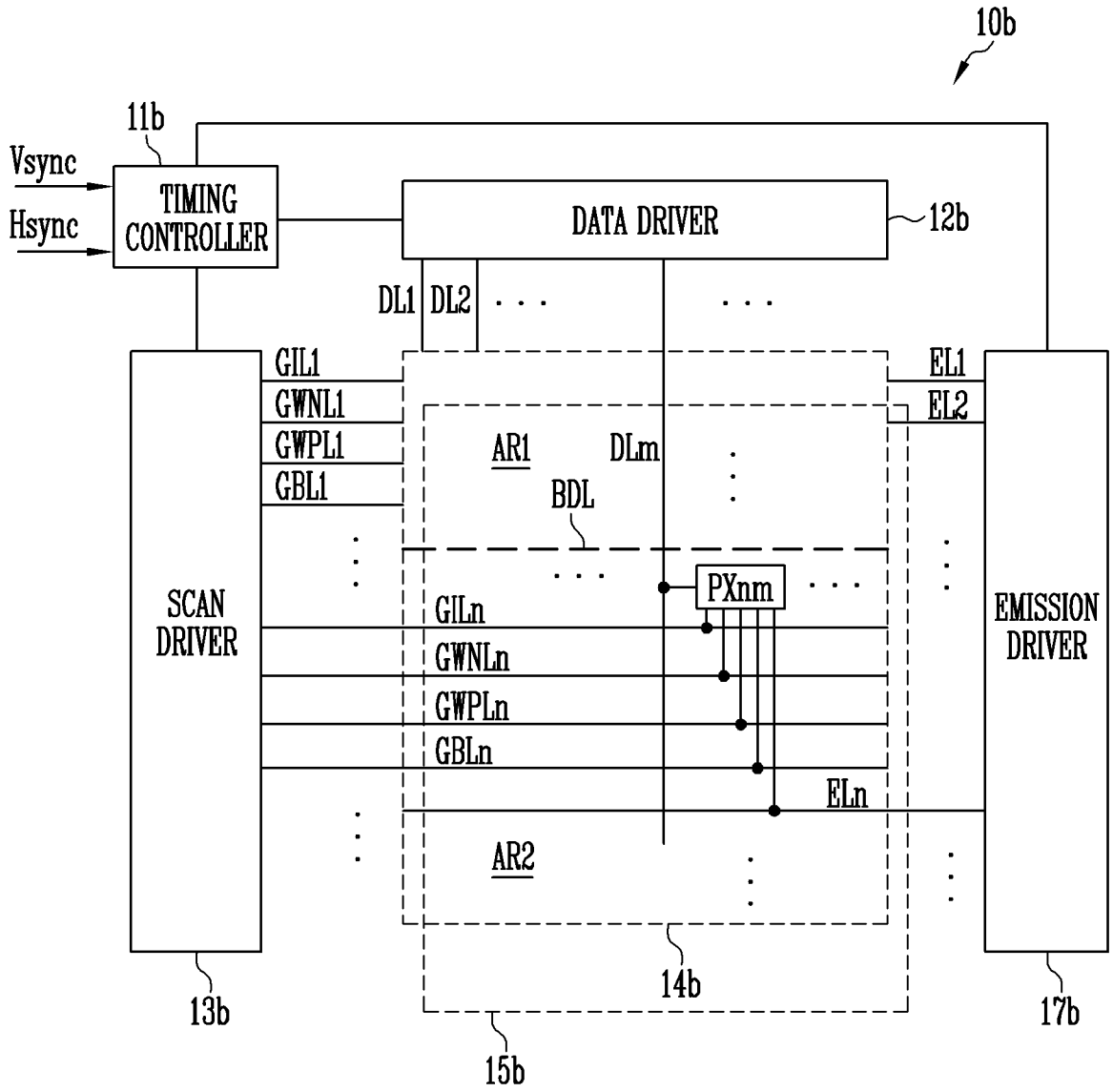
FIG. 12 is a block diagram of another exemplary embodiment of a display device constructed according to the principles of the invention.

FIG. 12 is a block diagram of another exemplary embodiment of a display device constructed according to the principles of the invention.

Referring to FIG. 12, the display device 10*b* may include a timing controller 11*b*, a data driver 12*b*, a scan driver 13*b*, an emission driver 17*b*, and a pixel unit 14*b*. Also, the display device 10*b* may further include a sensing unit 15*b* overlapping with the pixel unit 14*b*.

The timing controller 11*b* may receive an external input signal from an external processor. The external input signal may include a vertical synchronization signal Vsync, a horizontal synchronization signal Hsync, a data enable signal, grayscale values (e.g., an RGB data signal), and the like. The timing controller 11*b* may generate control signals to be supplied to the data driver 12*b*, the scan driver 13*b*, an emission driver 17*b*, and the like, based on the external input signal, to correspond to specifications of the display device 10*b*.

The data driver 12*b* may generate data voltages to be provided to data lines DL1, DL2, . . . , and DLm by using the grayscale values and control signals, which are received from the timing controller 11*b*. For example, the data driver 12*b* may sample grayscale values by using a clock signal, and supply data voltages corresponding to the grayscale values to the data lines DL1, DL2, . . . , and DLm in a unit of a pixel row.

The scan driver 13*b* may generate scan signals to be provided to scan lines GIL1 GWNL1, GWPL1, GBL1, . . . , GILn, GWNLn, GWPLn, and GBLn by receiving the clock signal, the scan start signal, and the like from the timing controller 11*b*. Here, n may be a natural number.

The scan driver 13*b* may include a plurality of sub-scan drivers. For example, a first sub-scan driver may provide scan signals for the scan lines GIL1 . . . , and GILn, a second sub-scan driver may provide scan signals for the scan lines GWNL1, . . . , and GWNLn, a third sub-scan driver may provide scan signals for the scan lines GWPL1, . . . , and GWPLn, and a fourth sub-scan driver may provide scan signals for the scan lines GBL1, . . . , and GBLn. Each of the sub-scan drivers may include a plurality of scan stages connected in the form of a shift register. For example, the scan driver 13*b* may generate scan signals in a manner that sequentially transfers the scan start signal having a pulse of a turn-on level, which is supplied to a scan start line, to a next scan stage.

In another example, the first and second sub-scan drivers may be integrated to provide scan signals of the scan lines GIL1, GWNL1, . . . , GILn, and GWNLn, and the third and fourth sub-scan drivers may be integrated to provide scan signals of the scan lines GWPL1, GBL1, . . . , GWPLn, and GBLn. For example, a previous scan line of an nth scan line GWNLn, i.e., an (n−1)th scan line may be connected to the same electrical node as an nth scan line GILn. For example, a next scan line of an nth scan line GWPLn, i.e., an (n+1)th scan line may be connected to the same electrical node as an nth scan line GBLn.

The first and second sub-scan drivers may supply scan signals having a first turn-on level to the scan lines GIL1, GWNL1, . . . , GILn, and GWNLn. The scan signals having the first turn-on level may be pulses having a first polarity.

In addition, the third and fourth sub-scan drivers may supply scan signals having a second turn-on level to the scan lines GWPL1, GBL1, . . . , GWPLn, and GBLn. The second turn-on level may be different from the first turn-on level. The scan signals having the second turn-on level may be pulses having a second polarity. The first polarity and the second polarity may be polarities opposite to each other.

Hereinafter, a polarity may mean a logic level of a pulse. For example, when the pulse has the first polarity, the pulse may have a high level. The pulse having the high level may be referred to as a rising pulse. When the rising pulse is supplied to a gate electrode of an N-type transistor, the N-type transistor may be turned on. That is, the rising pulse may have a turn-on level with respect to the N-type transistor. A case where a voltage having a level sufficiently lower than that of the gate electrode of the N-type transistor is applied to a source electrode of the N-type transistor is assumed. For example, the N-type transistor may be an NMOS transistor.

In addition, when the pulse has the second polarity, the pulse may have a low level. The pulse having the low level may be referred to as a falling pulse. When the falling pulse is supplied to a gate electrode of a P-type transistor, the P-type transistor may be turned on. That is, the falling pulse may be a turn-on level with respect to the P-type transistor. A case where a voltage having a level sufficiently higher than that of the gate electrode of the P-type transistor is applied to a source electrode of the P-type transistor is assumed. For example, the P-type transistor may be a PMOS transistor.

The emission driver 17*b* may generate emission signals to be provided to emission lines EL1, EL2, . . . , and ELn by receiving a clock signal, an emission stop signal, and the like from the timing controller 11*b*. For example, the emission driver 17*b* may sequentially provide the emission signals having a pulse of a turn-off level to the emission lines EL1, EL2, . . . , and ELn. For example, the emission driver 17*b* may be configured in the form of a shift register, and generate the emission signals in a manner that sequentially transfers the emission stop signal having a pulse of a turn-off level to a next emission stage under the control of the clock signal.

The pixel unit 14*b* includes pixels. For example, a pixel PXnm may be connected to a corresponding data line DLm, corresponding scan lines GILn, GWNLn, GWPLn, and GBLn, and a corresponding emission line ELn.

The pixel unit 14*b* may include a first area AR1 and a second area AR2, which are divided with respect to a boundary BDL. Definitions of the boundary BDL, the first area AR1, and the second area AR2 will refer to the description of FIG. 1.

Figure 13:
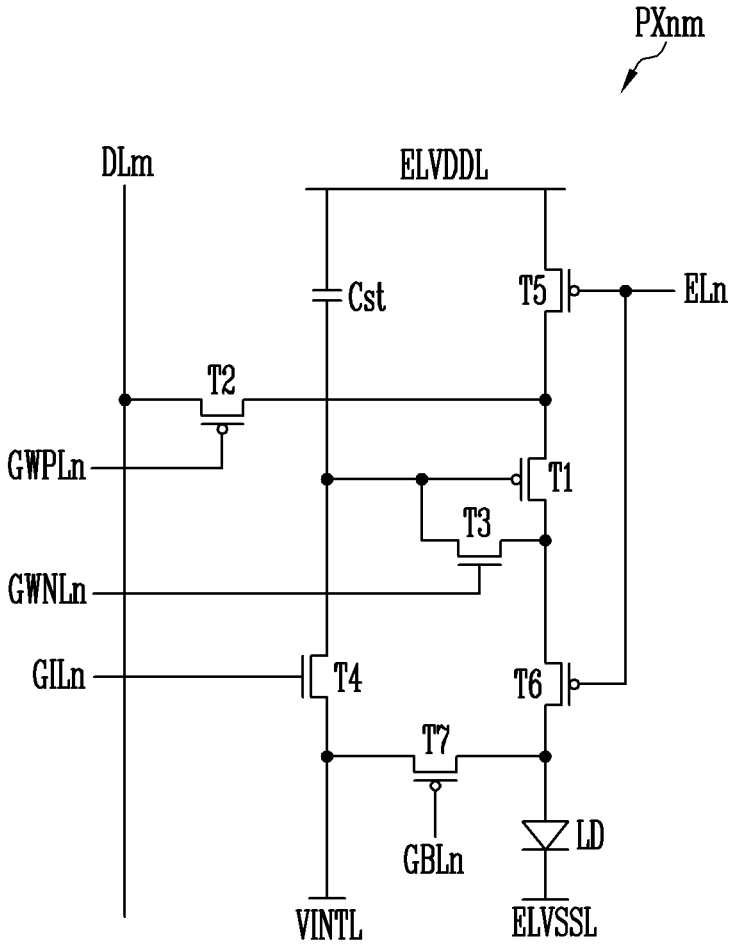
FIG. 13 is a circuit diagram of an exemplary embodiment of a representative pixel of the display device shown in FIG. 12.

FIG. 13 is a circuit diagram of an exemplary embodiment of a representative pixel of the display device shown in FIG. 12.

Referring to FIG. 13, the pixel PXnm may include transistors T1, T2, T3, T4, T5, T6, and T7, a storage capacitor Cst, and a light emitting diode LD.

A first electrode of the first transistor T1 may be connected to a first electrode of the second transistor T2, a second electrode of the first transistor T1 may be connected to a first electrode of the third transistor T3, and a gate electrode of the first transistor T1 may be connected to a second electrode of the third transistor T3. The first transistor T1 may be referred to as a driving transistor.

The first electrode of the second transistor T2 may be connected to the first electrode of the first transistor T1, a second electrode of the second transistor T2 may be connected to a data line DLm, and a gate electrode of the second transistor T2 may be connected to a scan line GWPLn. The second transistor T2 may be referred to as a scan transistor.

The first electrode of the third transistor T3 may be connected to the second electrode of the first transistor T1, the second electrode of the third transistor T3 may be connected to the gate electrode of the first transistor T1, and a gate electrode of the third transistor T3 may be connected to a scan line GWNLn. The third transistor T3 may be referred to as a diode connection transistor.

A first electrode of the fourth transistor T4 may be connected to a second electrode of the storage capacitor Cst, a second electrode of the fourth transistor T4 may be connected to an initialization line VINTL, and a gate electrode of the fourth transistor T4 may be connected to a scan line GILn. The fourth transistor T4 may be referred to as a gate initialization transistor.

A first electrode of the fifth transistor T5 may be connected to a power line ELVDDL, a second electrode of the fifth transistor T5 may be connected to the first electrode of the first transistor T1, and a gate electrode of the fifth transistor T5 may be connected to an emission line ELn. The fifth transistor T5 may be referred to as a first emission transistor.

A first electrode of the sixth transistor T6 may be connected to the second electrode of the first transistor T1, a second electrode of the sixth transistor T6 may be connected to an anode of the light emitting diode LD, and a gate electrode of the sixth transistor T6 may be connected to the emission line ELn. The sixth transistor T6 may be referred to as a second emission transistor.

A first electrode of the seventh transistor T7 may be connected to the anode of the light emitting diode LD, a second electrode of the seventh transistor T7 may be connected to the initialization line VINTL, and a gate electrode of the seventh transistor T7 may be connected to a scan line GBLn. The seventh transistor T7 may be referred to as an anode initialization transistor.

A first electrode of the storage capacitor Cst may be connected to the power line ELVDDL, and the second electrode of the storage capacitor Cst may be connected to the gate electrode of the first transistor T1.

The anode of the light emitting diode LD may be connected to the second electrode of the sixth transistor T6, and a cathode of the light emitting diode LD may be connected to a power line ELVSSL. A voltage applied to the power line ELVSSL may be set lower than that applied to the power line ELVDDL. The light emitting diode LD may be an organic light emitting diode, an inorganic light emitting diode, a quantum dot light emitting diode, or the like.

The transistors T1, T2, T5, T6, and T7 may be implemented with a P-type transistor. Channels of the transistors T1, T2, T5, T6, and T7 may be configured with poly-silicon. The poly-silicon transistor may be a Low Temperature Poly-Silicon (LTPS) transistor. The poly-silicon transistor has high electron mobility, and has a fast driving characteristic according to the high electron mobility.

The third and fourth transistors T3 and T4 may be implemented with an N-type transistor. Channels of the third and fourth transistors T3 and T4 may be configured with an oxide semiconductor. The oxide semiconductor transistor can be formed through a low temperature process, and has a charge mobility lower than that of the poly-silicon transistor. Thus, the oxide semiconductor transistors have an amount of leakage current generated in a turn-off state, which is smaller than that of the poly-silicon transistors.

In some exemplary embodiments, the seventh transistor T7 may be configured with an N-type oxide semiconductor transistor instead of the poly-silicon transistor. In substitute for the scan line GBLn, one of the scan lines GWNLn and GILn may be connected to the gate electrode of the seventh transistor T7.

FIGS. 14 to 19 are diagrams illustrating a driving method of the pixel shown in FIG. 13.

Figure 14:
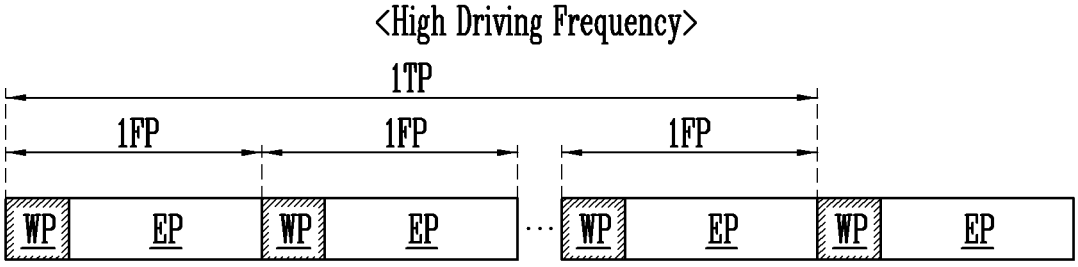
FIG. 14 is a diagram illustrating an exemplary, high driving frequency operation of the pixel of FIG. 13.

FIG. 14 is a diagram illustrating an exemplary, high driving frequency operation of the pixel of FIG. 13.

When the pixel unit 14*b* displays frames at a first driving frequency, it may be expressed that the display device 10*b* is in a first frequency mode. Also, when the pixel unit 14*b* displays frames at a second driving frequency lower than the first driving frequency, it may be expressed that the display device 10*b* is in a second frequency mode.

In the first frequency mode, the display device 10*b* may display image frames at 20 Hz or higher, e.g., 60 Hz.

The second frequency mode may be a low power display mode. For example, the display device 10*b* may display image frames at less than 20 Hz, e.g., 1 Hz. For example, a case where only time and date are displayed in an "always on mode" during a common use mode may correspond to the second frequency mode.

A period 1TP may include a plurality of frame periods 1FP. The period 1TP is a period which is arbitrarily defined so as to compare the first frequency mode and the second frequency mode. The period 1TP may mean the same time interval in the first frequency mode and the second frequency mode. For convenience of description, a case where a frame period 1FP has the same time interval in the first frequency mode and the second frequency mode is assumed. Therefore, the period 1TP in the first frequency mode and the second frequency mode may include the same number of frame periods 1FP.

In the first frequency mode, each frame period 1FP may include a data write period WP and an emission period EP. For convenience of description, a case where, based on a first pixel row, the data write period WP is located at an initial stage of the frame period 1FP and the emission period EP is located next to the data write period WP is illustrated in FIG. 14. However, in the case of a pixel row which is not the first pixel row, the data write period WP may be located at an intermediated or late stage of the frame period 1FP.

Therefore, the pixel PXnm may display a plurality of image frames corresponding to a number of frame periods 1FP during the period 1TP, based on data voltages received in data write periods WP.

Figure 15:
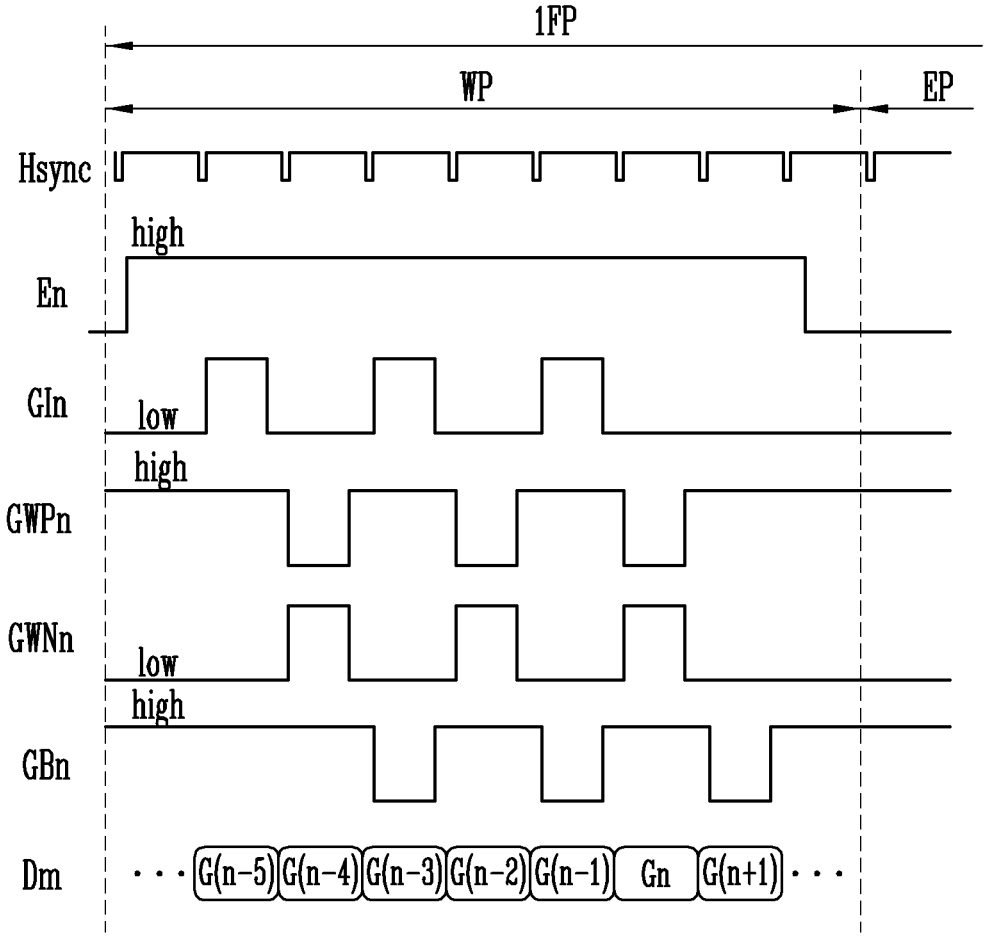
FIG. 15 is a timing diagram of an exemplary embodiment of a data write period shown in FIG. 14.
Figure 16:
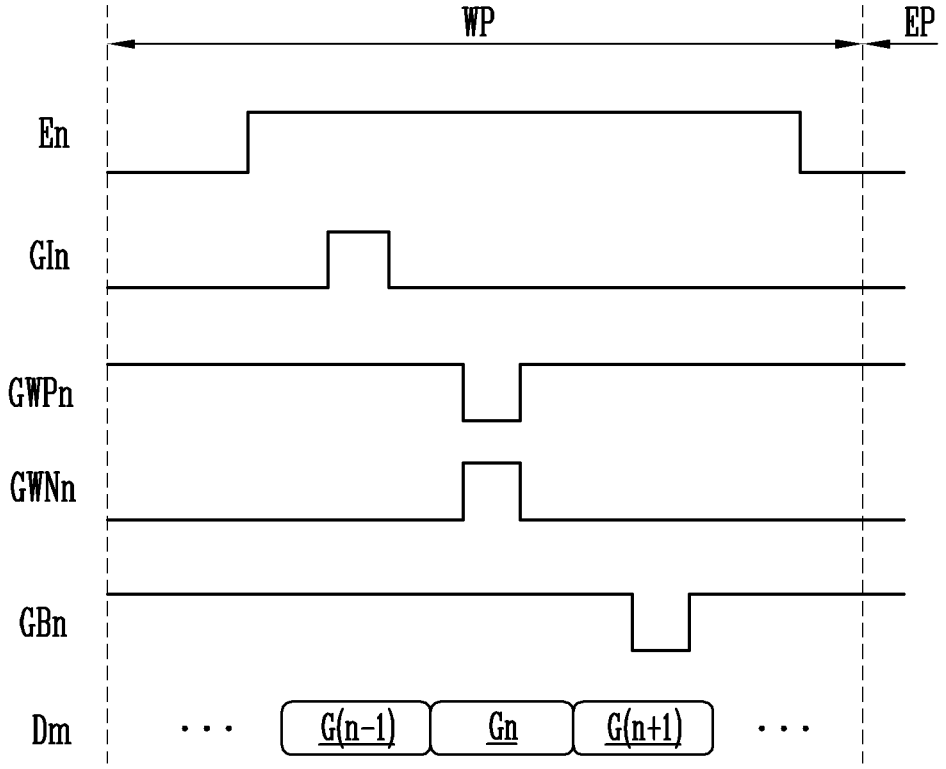
FIG. 16 is a timing diagram of another exemplary embodiment of a data write period shown in FIG. 14.

FIG. 15 is a timing diagram of an exemplary embodiment of a data write period shown in FIG. 14. FIG. 16 is a timing diagram of another exemplary embodiment of a data write period shown in FIG. 14.

Referring to FIGS. 13, 15 and 16, first, an emission signal En having a turn-off level (high level) may be supplied to the emission line ELn during the data write period WP as shown in FIGS. 15 and 16. Therefore, the fifth and sixth transistors T5 and T6 may be in a turn-off state during the data write period WP.

Also, a first pulse of a turn-on level (high level) is supplied to the scan line GILn. Accordingly, the fourth transistor T4 is turned on, and the gate electrode of the first transistor T1 and the initialization line VINTL are connected to each other. Accordingly, a voltage of the gate electrode of the first transistor T1 is initialized to an initialization voltage of the initialization line VINTL, and is maintained by the storage capacitor Cst. For example, the initialization voltage of the initialization line VINTL may be a voltage sufficiently lower than a voltage of the power line ELVDDL. For example, the initialization voltage may be a voltage having a level equal or similar to that of the voltage of the power line ELVDDL. Therefore, the first transistor T1 may be turned on.

Next, first pulses of a turn-on level are supplied to the scan lines GWPLn and GWNLn, and the corresponding second and third transistors T2 and T3 are turned on. Accordingly, a data voltage Dm applied to the data line DLm is written in the storage capacitor Cst through the second transistor T2, the first transistor T1, and the third transistor T3. For example, however, in the exemplary embodiment of FIG. 15, the data voltage Dm corresponds to a grayscale value G(n−4) of the pixel before four horizontal periods. The data voltage Dm is not used for emission of the pixel PXnm but used to apply an on-bias voltage to the first transistor T1. When the on-bias voltage is applied before a desired data voltage Dm is written to the first transistor T1, a hysteresis phenomenon can be minimized.

Next, a first pulse having a turn-on level (low level) is supplied to the scan line GBLn, and the seventh transistor T7 is turned on. Therefore, an anode voltage of the light emitting diode LD is initialized.

A second pulse having a turn-on level (high level) is supplied to the scan line GILn, and the described-above driving process is again performed. That is, the on-bias voltage is again applied to the first transistor T1, and the anode voltage of the light emitting diode LD is initialized.

By repeating the above-described process, when third pulses having a turn-on level are supplied to the scan lines GWPLn and GWNLn, a data voltage Dm corresponding to a grayscale value Gn of the pixel PXnm is written in the storage capacitor Cst. The data voltage Dm written in the storage capacitor Cst is a voltage obtained by reflecting a decrement of a threshold voltage of the first transistor T1.

Finally, when the emission signal En becomes a turn-on level (low level), the fifth and sixth transistors T5 and T6 are in a turn-on state. Accordingly, a driving current path is formed, through which the power line ELVDDL, the fifth transistor T5, the first transistor T1, and the sixth transistor T6, the light emitting diode LD, and the power line ELVSSL are connected, and a driving current flows through the driving current path. The amount of driving current corresponds to the data voltage Dm stored in the storage capacitor Cst. Since the driving current flows through the first transistor T1, a decrement of the threshold voltage of the first transistor T1 is reflected. Accordingly, the decrement of the threshold voltage, which is reflected to the data voltage Dm stored in the storage capacitor Cst, and the decrement of the threshold voltage, which is reflected to the driving current, are cancelled with each other, and thus a driving current corresponding to the data voltage Dm can flow regardless of the threshold voltage of the first transistor T1.

The light emitting diode LD emits light with a desired luminance according to the amount of driving current.

In this embodiment, a case where each scan signal includes three pulses is described. However, in another embodiment, each scan signal may include two or four or more pulses. In still another embodiment, each scan signal may include one pulse, and therefore, the process of applying the on-bias voltage to the first transistor T1 is omitted (see FIG. 15).

In addition, an interval between adjacent pulses of the horizontal synchronization signal Hsync may correspond to one horizontal period. Although a case where a pulse of the horizontal synchronization signal Hsync has a low level is illustrated in FIG. 4, the pulse of the horizontal synchronization signal Hsync may have a high level in another exemplary embodiment.

Figure 17:
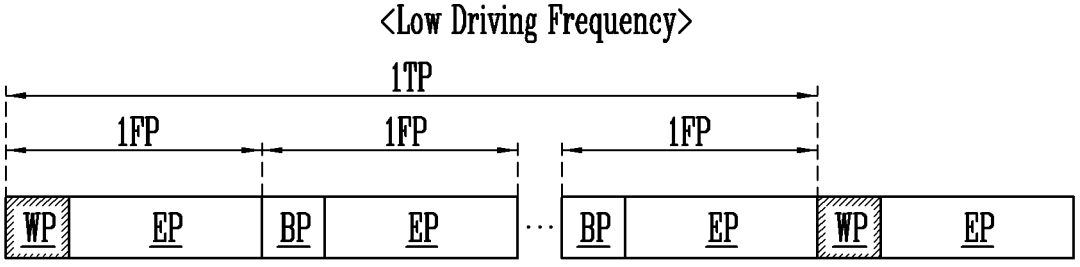
FIG. 17 is a diagram illustrating an exemplary, low driving frequency operation of the pixel of FIG. 13.

FIG. 17 is a diagram illustrating an exemplary, low driving frequency operation of the pixel of FIG. 13.

In the second frequency mode, a first frame period 1FP during a period 1TP may include a data write period WP and an emission period EP, and each of the other frame periods 1FP during the first frame period 1FP may include a bias refresh period BP and an emission period EP.

The third and fourth transistors T3 and T4 of the pixel PXnm maintain the turn-off state in the other image frames 1FP during the period TP, and therefore, the storage capacitor Cst maintains the same data voltage during a plurality of image frames. In particular, the third and fourth transistors T3 and T4 are configured as oxide semiconductor transistors, and thus leakage current can be minimized.

Thus, the pixel PXnm can display the same single image frame during the period TP, based on a data voltage supplied during the data write period WP.

Figure 18:
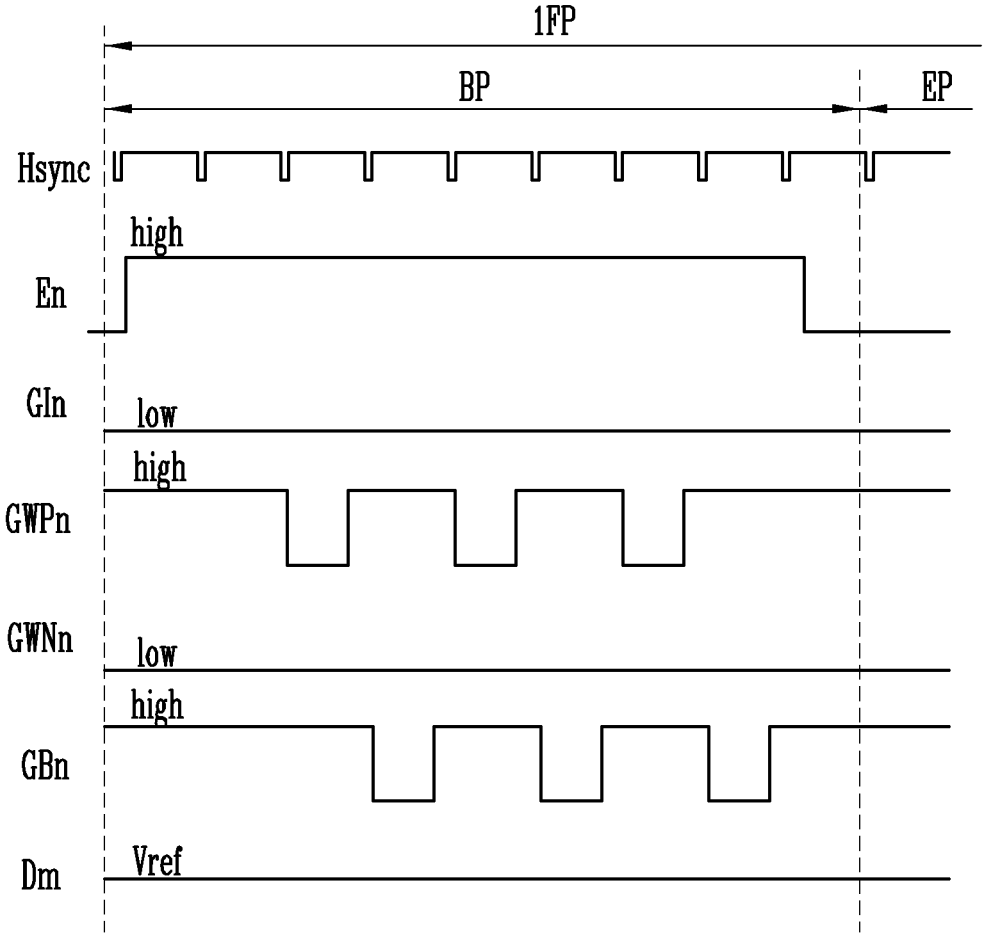
FIG. 18 is a timing diagram of an exemplary embodiment of a bias refresh period shown in FIG. 17.
Figure 19:
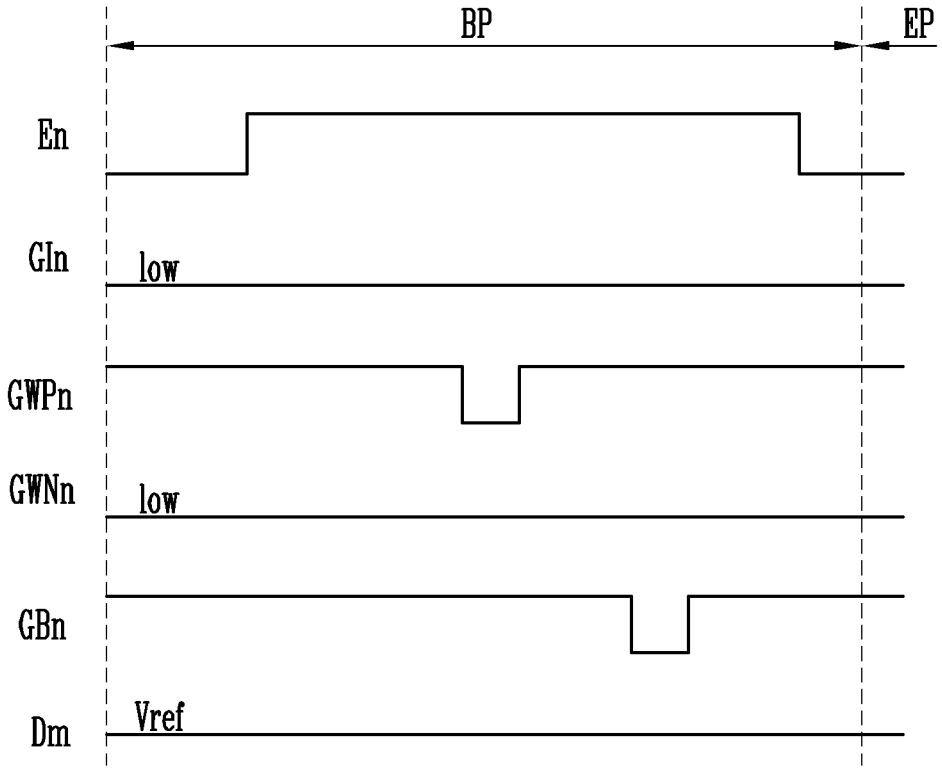
FIG. 19 is a timing diagram of another exemplary embodiment of a data write period shown in FIG. 17.

FIG. 18 is a timing diagram of an exemplary embodiment of a bias refresh period shown in FIG. 17. FIG. 19 is a timing diagram of another exemplary embodiment of a data write period shown in FIG. 17.

Referring to FIG. 18, in the bias refresh period BP, scan signals GIn and GWNn having a turn-off (low level) are supplied. Therefore, as described above, a data voltage written in the storage capacitor Cst is not changed in the bias refresh period BP. A reference data voltage Vref may be applied to the data line DLm.

However, in the bias refresh period BP, an emission signal En and scan signals GWPn and GBn, which have the same wavelengths as those in the data write period WP, may be supplied. Thus, in a plurality of frame periods 1FP of the period 1TP, lights emitted from the light emitting diode LD have similar wavelengths, so that any flicker is not viewed by a user in low frequency driving.

The pixel PXnm shown in FIG. 13 is an exemplary embodiment suitable for high frequency driving and low frequency driving. Exemplary embodiments which will be described later may be applied even to a pixel having another circuit, on which high frequency driving and low frequency driving can be performed. For example, the transistors T1 to T7 of the pixel PXnm may all be configured as only P-type transistors. Thus, the scan driver includes only a sub-scan driver of the P-type transistors, and accordingly, the configuration of the scan driver can be simplified. For example, the transistors of the pixel PXnm may not include the emission transistors T5 and T6. Therefore, the emission driver 17*b* may be unnecessary.

In this exemplary embodiment, a case where each of the scan signals GWPn and GBn includes three pulses is described. However, in another exemplary embodiment, each of the scan signals GWPn and GBn may include two or four or more pulses. In still another exemplary embodiment, each of the scan signals GWPn and GBn may include one pulse, and therefore, the process of applying the on-bias voltage to the first transistor T1 is omitted.

Figure 20:
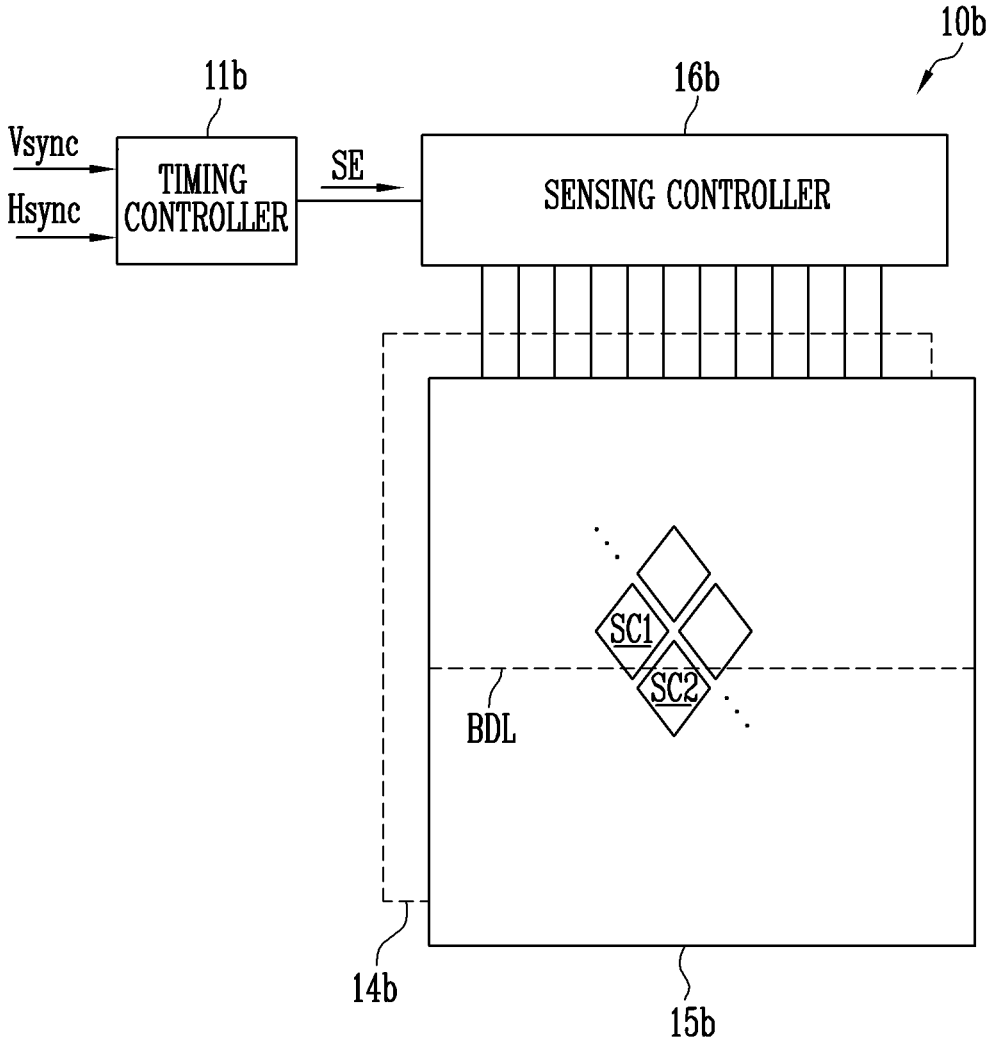
FIG. 20 is a block diagram of an exemplary embodiment of a sensing unit shown in FIG. 12.

FIG. 20 is a block diagram of an exemplary embodiment of a sensing unit shown in FIG. 12.

Referring to FIG. 20, the display device 10*b* may further include a sensing unit 15*b* and a sensing controller 16*b*. The sensing unit 15*b* and the sensing controller 16*b* may be configured substantially identical to the sensing unit 15*a* and the sensing controller 16*a*, and therefore, will refer to the descriptions of FIGS. 4 to 6.

FIGS. 21 to 24 are diagrams illustrating a driving method of the display device shown in FIG. 12 in a first mode and a driving method of the display device shown in FIG. 12 in a second mode.

Figure 21:
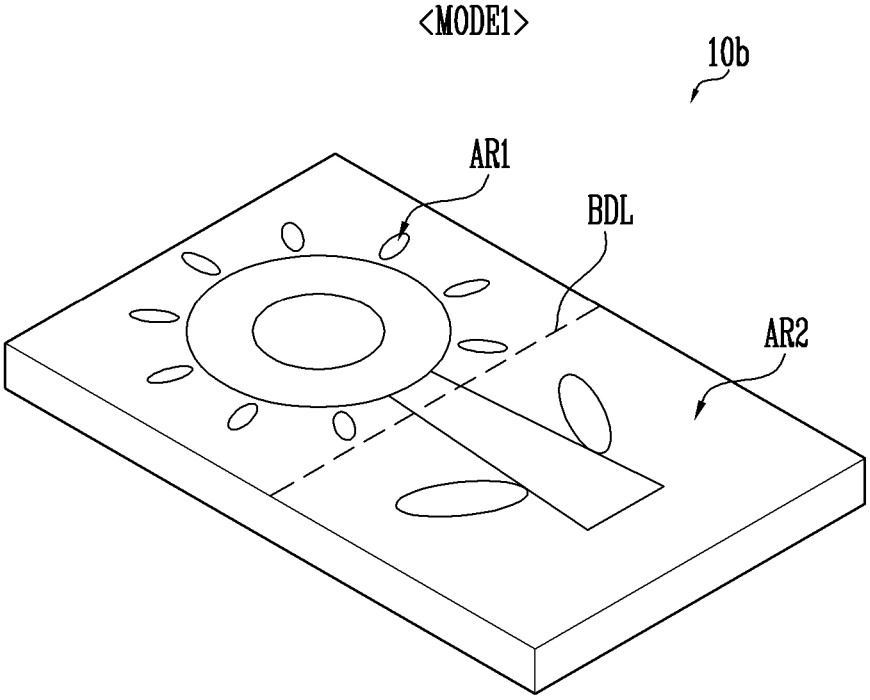
FIG. 21 is perspective view of the display device of FIG. 12 in a first mode (unfolded state).

FIG. 21 is perspective view of the display device of FIG. 12 in a first mode (unfolded state). Referring to FIG. 21, a case where both the first area AR1 and the second AR2 of the display device 10*b* are driven in a first frequency mode may be defined as a first mode. For example, in the first mode, the display device 10*b* may driver both the areas AR1 and AR2 in the first frequency mode, without distinguishing the boundary BDL and the areas AR1 and AR2. For example, in the first mode, the display device 10*b* may display a moving image at a front surface of the pixel unit 14*b*.

Figure 22:
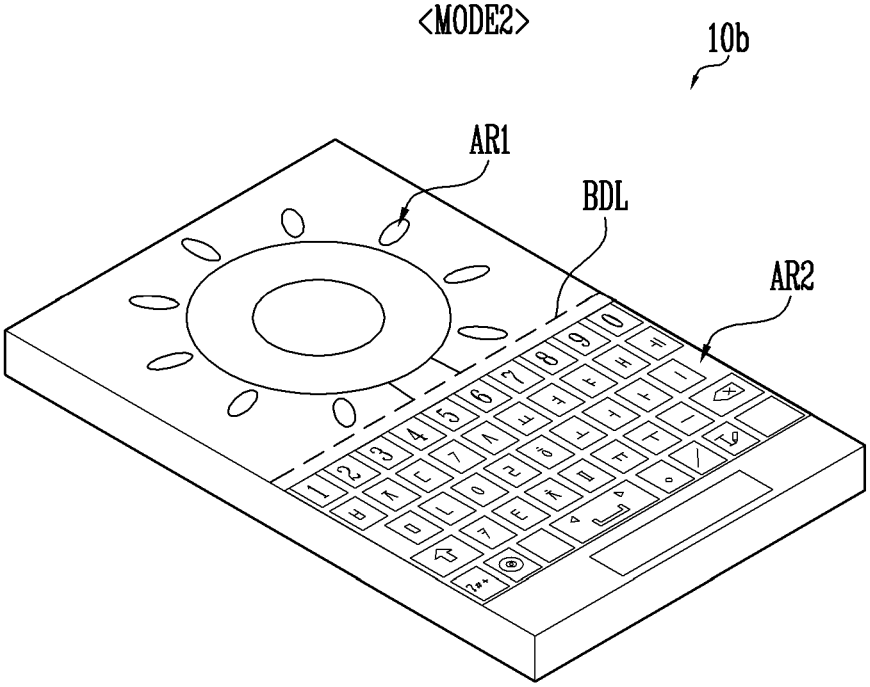
FIG. 22 is perspective view of the display device of FIG. 12 in a second mode (folded state).

FIG. 22 is perspective view of the display device of FIG. 12 in a second mode (folded state). Referring to FIG. 22, a case where the first area AR1 is driven in the first frequency mode and the second area AR2 is driven in a second frequency mode may be defined as a second mode. For example, in the second mode, the first area AR1 may display a moving image, and the second area AR2 may display a relatively static image such as a keyboard, a note pad, a clock, or a still image. That is, a frequency of the image displayed in the first area AR1 and a frequency of the image displayed in the second area AR2 may be different from each other.

Figure 23:
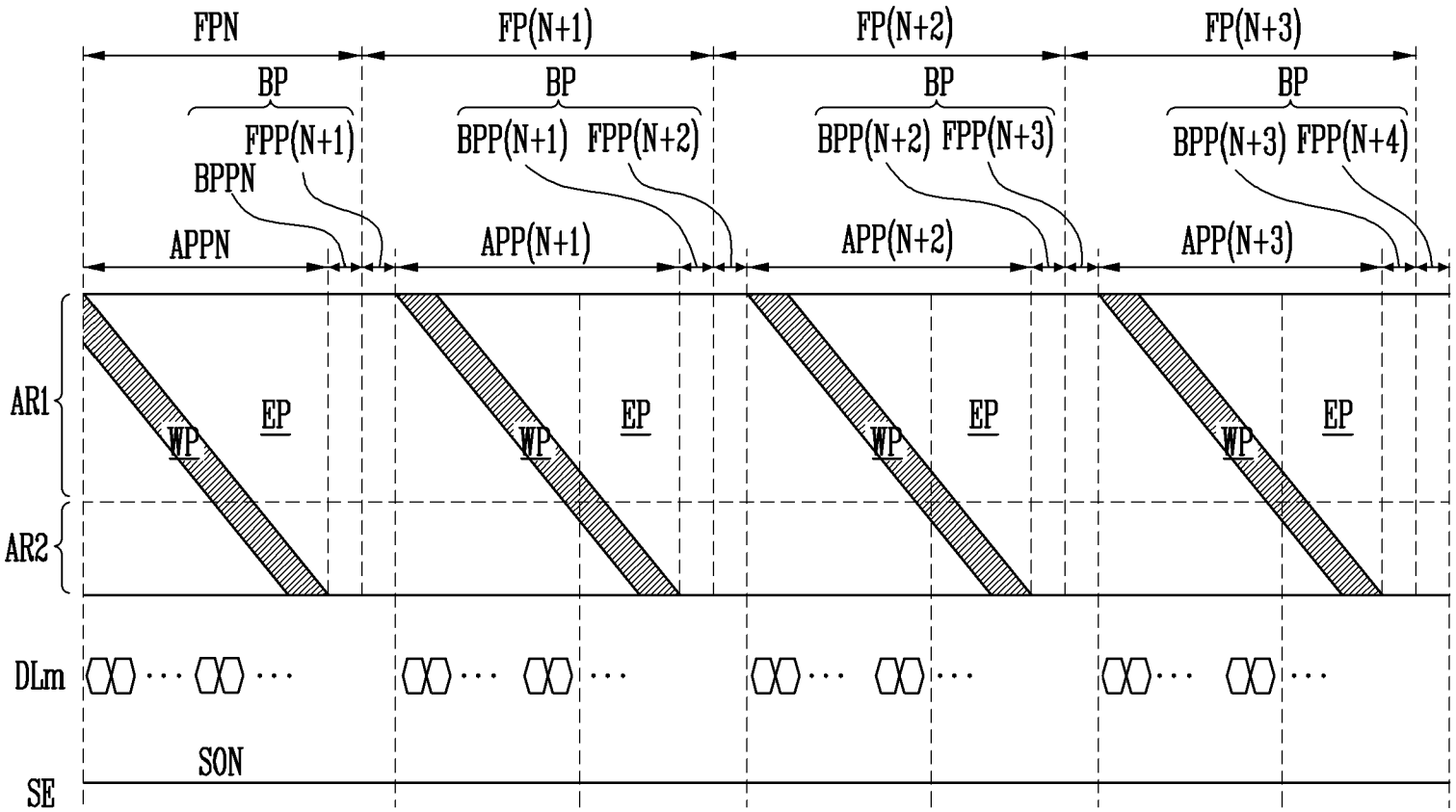
FIG. 23 is a timing diagram of an exemplary embodiment of a driving method of the display device shown in FIG. 12 in the first mode.

FIG. 23 is a timing diagram of an exemplary embodiment of a driving method of the display device shown in FIG. 12 in the first mode. Referring to FIG. 23, frame periods FPN, FP(N+1), FP(N+2), and FP(N+3) when the display device 10*b* is driven in the first mode are illustrated. The frame periods FPN, FP(N+1), FP(N+2), and FP(N+3) may include corresponding front porch periods FPP(N+1), FPP(N+2), FPP(N+3), and FPP(N+4), corresponding active periods APPN, APP(N+1), APP(N+2), and APP(N+3), and corresponding back porch periods BPPN, BPP(N+1), BPP(N+2), and BPP(N+3).

During the active periods APPN to APP(N+3), first data voltages for first pixels of the first area AR1 may be applied to the data line DLm. At least two of the first data voltages may have different levels. Therefore, the first area AR1 may display an image instead of a single color at a first driving frequency.

During the active periods APPN to APP(N+3), second data voltages for second pixels of the second area AR2 may be applied to the data line DLm. At least two of the second data voltages may have different levels. Therefore, the second area AR2 may display an image instead of a single color at the first driving frequency.

The above-described data write periods WP may be located in the corresponding active periods APPN to APP (N+3). The above-described emission periods EP may be the other periods except the data write periods WP.

In the first mode, a sensing-on level SON can be maintained throughout all the frame periods FPN to FP(N+3), in spite of a coupling noise caused due to voltage fluctuation of the data line DLj. For example, the timing controller 11*b* or the sensing controller 16*b* compensates for a decrease in sensing sensitivity due to the coupling noise through a large number of sensing values, so that a touch position can be more accurately determined.

Figure 24:
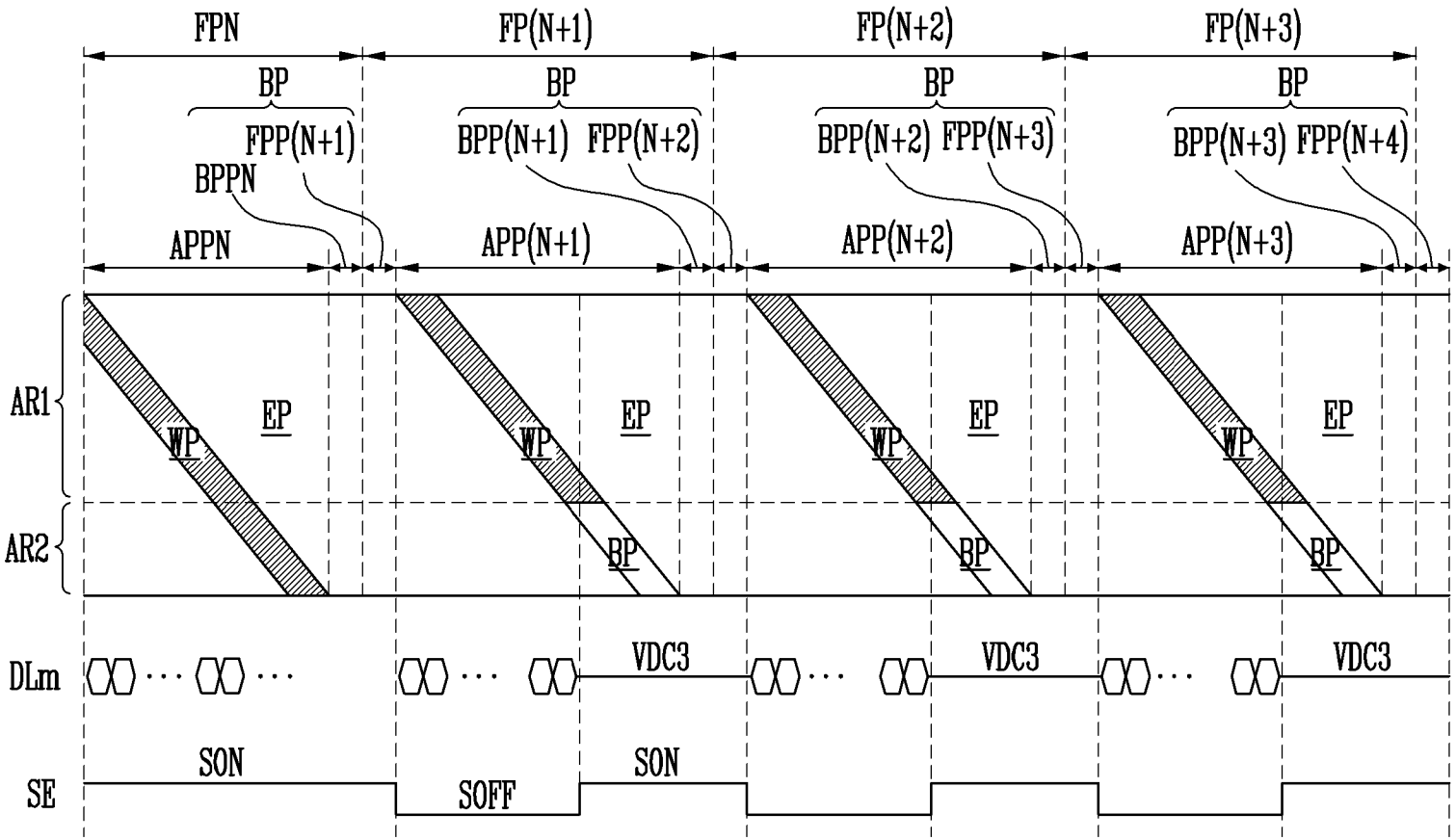
FIG. 24 is a timing diagram of an exemplary embodiment of a driving method of the display device shown in FIG. 12 in the second mode.

FIG. 24 is a timing diagram of an exemplary embodiment of a driving method of the display device shown in FIG. 12 in the second mode. Referring to FIG. 24, frame periods FPN, FP(N+1), FP(N+2), and FP(N+3) when the display device 10*b* is driven in a second mode is illustrated.

Based on a plurality of consecutive frame periods FPN, FP(N+2), and FP(N+3) including a frame period FP(N+1), frequencies of images displayed by the first pixels of the first area AR1 and the second pixel of the second area AR2 may be different from each other. The first area AR1 may display an image at a first driving frequency, and the second area AR2 may display an image at a second driving frequency.

In a first frame period FPN, the first pixels of the first area AR1 and the second pixel of the second area AR2 may all be driven according to data write periods WP.

In the frame period FPN, at least two of first data voltages for the first pixels may have different levels, and at least two of second data voltages for the first pixels may have different levels.

Referring to FIGS. 13 to 16 and 24, in the frame period FPN, scan signals having the first turn-on level (high level) may be supplied at least once to first scan lines GILn and GWNLn among the scan lines to which the first pixels are connected. Also, in the frame period FPN, scan signals having the second turn-on level (low level) may be supplied at least once to second scan lines GWPLn and GBLn among the scan lines to which the first pixels are connected.

In the frame period FPN, scan signals having the first turn-on level may be supplied at least once to third scan lines GILn and GWNLn among the scan lines GILn, GWPLn, GWNLn, and GBLn to which the second pixels are connected. Also, in the frame period FPN, scan signals having the second turn-on level may be supplied at least once to fourth scan lines GWPLn and GBLn among the scan lines GILn, GWPLn, GWNLn, and GBLn to which the second pixels are connected.

Therefore, the first and second pixels may respectively store the first data voltages and the second data voltages, and display an image instead of a single color.

In the frame period FPN, the sensing enable signal SE may have the sensing-on level SON while the first data voltages are being applied to the data line DLm, and have the sensing-on level SON while the second data voltages are being applied to the data line DLm.

In the frame periods FP(N+1), FP(N+2), and FP(N+3) after the frame period FPN, the first pixels of the first area AR1 may be driven according to data write periods WP, and the second pixels of the second area AR2 may be driven according to bias refresh periods BP.

In the frame periods FP(N+1), FP(N+2), and FP(N+3), at least two of first data voltages applied to the data line DLm, corresponding to the first pixels, may have different levels, and second data voltages applied to the data line DLm, corresponding to the second pixels, may have the same level VDC3.

Referring to FIGS. 13, 17 to 19 and 24, in the frame periods FP(N+1), FP(N+2), and FP(N+3), scan signals having the first turn-on level (high level) may be supplied at least once to the first scan lines GILn and GWNLn among the scan lines to which the first pixels are connected. Also, in the frame periods FP(N+1), FP(N+2), and FP(N+3), scan signals having the second turn-on level (low level) may be supplied at least once to the second scan lines GWPLn and GBLn among the scan lines to which the first pixels are connected.

In the frame periods FP(N+1), FP(N+2), and FP(N+3), scan signals having a turn-off level (low level) may be maintained in the third scan lines GILn and GWNLn among the scan lines GILn, GWPLn, GWNLn, and GBLn to which the second pixels are connected. Also, in the frame periods FP(N+1), FP(N+2), and FP(N+3), scan signals having the second turn-on level may be supplied at least once to the fourth scan lines GWPLn and GBLn among the scan lines GILn, GWPLn, GWNLn, and GBLn to which the second pixels are connected.

Therefore, the first pixels may store the first data voltages, and display an image instead of a single color. The displayed image may be changed for each frame period. Thus, the first pixels can display an image at the first driving frequency which is relatively high.

Since the second pixels do not store the second data voltages, an image may be displayed based on the second data voltages stored in the frame period FPN. The display image may not be a single color. Therefore, images displayed in the frame periods FPN, FP(N+1), FP(N+2), and FP(N+3) may all be the same. Thus, the second pixels can display an image at the second driving frequency which is relatively low.

In the frame periods FP(N+1), FP(N+2), and FP(N+3), the sensing enable signal SE may have the sensing-off level SOFF while the first data voltages are being applied to the data line DLm, and have the sensing-on level SON while the second data voltages are being applied to the data line DLm.

Since the level VDC3 of the second data voltages is maintained (i.e., a DC level), the coupling noise is not generated while the second data voltages are being applied to the data line DLj. Thus, the timing controller 11*b* or the sensing controller 16*b* senses a touch position only while the second data voltages are being applied to the data line DLj, so that high sensing sensitivity can be maintained. Touch sensing may be made at a front surface of the sensing unit 15*b*, and is not limited to a portion overlapping with the second area AR2.

Further, although a sensing period in each of the frame periods FP(N+1), FP(N+2), and FP(N+3) is shorter than that of the frame period FPN, the short sensing period can be compensated due to the high sensing sensitivity. Furthermore, the sensing controller 16*b* and the sensing unit 15*b* do not operate while the first data voltages are being applied to the data line DLj, and accordingly, power consumption can be reduced.

In the display device and the driving method thereof, sensing sensitivity can be increased by avoiding a coupling noise, when different driving methods are applied to pixel areas.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a pixel unit including first pixels connected to a data line and second pixels connected to the data line;

a sensing unit overlapping the first pixels and the second pixels, the sensing unit including sensing electrodes; and a sensing controller configured to receive a sensing signal from at least some of the sensing electrodes while second data voltages are applied to the data line in accordance with a sensing enable signal having a sensing-on level, wherein, in a first frame period, at least two of first data voltages having different levels are applied through the data line to the first pixels and the second data voltages having the same level as each other are applied through the data line to the second pixels, and wherein, in the first frame period, the sensing enable signal has a sensing-off level while the first data voltages are applied, and the sensing-on level while the second data voltages are applied.

2. The display device of claim 1, wherein the first frame period includes an active period in which the first data voltages and the second data voltages are applied to the data line and a blank period in which a reference voltage is applied to the data line, and wherein the sensing enable signal has a sensing-on level during the blank period.

3. The display device of claim 2, wherein the second data voltages and the reference voltage have the same level.

4. The display device of claim 1, wherein, in a second frame period different from the first frame period, at least two of the first data voltages have different levels, wherein, in the second frame period, at least two of the second data voltages have different levels, and wherein, in the second frame period, the sensing enable signal has a sensing-on level while the first data voltages are being applied to the data line, and has a sensing-on level while the second data voltages are being applied to the data line.

5. The display device of claim 4, wherein, in the first frame period, the pixel unit is disposed in a folded portion of the display device, and wherein, in the second frame period, the pixel unit is disposed in an unfolded portion of the display device.

6. The display device of claim 1, wherein the first pixels and the second pixels are connected to different scan lines.

7. The display device of claim 6, wherein the scan lines to which the first pixels are connected are consecutively arranged, and wherein the scan lines to which the second pixels are connected are consecutively arranged.

8. The display device of claim 7, wherein the first data voltages are sequentially applied to the data line, and wherein the second data voltages are sequentially applied to the data line.

9. The display device of claim 6, wherein, in the first frame period, scan signals having a turn-off level are maintained in the scan lines to which the second pixels are connected.

10. The display device of claim 1, wherein, in the first frame period, the first pixels are configured to display a color image, and wherein, in the first frame period, the second pixels are configured to display a black image or do not display any image.

11. The display device of claim 10, wherein, in the first frame period, the pixel unit is disposed in a folded portion of the display device.

12. The display device of claim 10, wherein, in the first frame period, the pixel unit is disposed in a folded portion of the display device with respect to a folding line located between the first pixels and the second pixels.

13. The display device of claim 1, wherein images to be displayed by the first pixels and the second pixels in consecutive frame periods including the first frame period have different frequencies from each other.

14. The display device of claim 13, wherein the consecutive frame periods include a second frame period prior to the first frame period, wherein, in the second frame period, at least two of the first data voltages have different levels, wherein, in the second frame period, at least two of the second data voltages have different levels, and wherein, in the second frame period, the sensing enable signal has the sensing-on level while the first data voltages are applied to the data line, and has the sensing-on level while the second data voltages are applied to the data line.

15. The display device of claim 14, wherein, in the second frame period, scan signals having a first turn-on level are supplied at least once to first scan lines among the scan lines to which the first pixels are connected, wherein, in the second frame period, scan signals having a second turn-on level are supplied at least once to second scan lines among the scan lines to which the first pixels are connected, wherein, in the second frame period, scan signals having the first turn-on level are supplied at least once to third scan lines among the scan lines to which the second pixels are connected, wherein, in the second frame period, scan signals having the second turn-on level are supplied at least once to fourth scan lines among the scan lines to which the second pixels are connected, and wherein the first turn-on level and the second turn-on level are different from each other.

16. The display device of claim 15, wherein, in the first frame period, scan signals having the first turn-on level are supplied at least once to the first scan lines, wherein, in the first frame period, scan signals having the second turn-on level are supplied at least once to the second scan lines, wherein, in the first frame period, scan signals having a turn-off level are maintained in the third scan lines, and wherein, in the first frame period, scan signals having the second turn-on level are supplied at least once to the fourth scan lines.

17. The display device of claim 13, wherein, in the first frame period, scan signals having a turn-on level are supplied at least once to the scan lines to which the first pixels are connected, and wherein, in the first frame period, scan signals having a turn-off level are maintained in at least some of the scan lines to which the second pixels are connected.

18. A method for driving a display device having first pixels connected to a data line, second pixels connected to the data line, and sensing electrodes overlapping the first pixels and the second pixels, the method comprising the steps of:

in a first frame period, sequentially applying first data voltages having different levels through the data line to the first pixels, in the first frame period, sequentially applying second data voltages having the same level as each other through the data line to the second pixels, and receiving a sensing signal from at least some of the sensing electrodes while the second data voltages are applied to the data line in accordance with a sensing enable signal, wherein, in the first frame period, the sensing enable signal has a sensing-off level while the first data voltages are applied, and has the sensing-on level while the second data voltages are applied.

19. The method of claim 18, wherein, in the first frame period, the first pixels are configured to display a color image, wherein, in the first frame period, the second pixels are configured to display a black image or do not display any image.

20. The method of claim 18, wherein images displayed by the first pixels and the second pixels have different frequencies from each other.

* * * * *